US011338423B2

(12) United States Patent
Lamb, Sr. et al.

(10) Patent No.: US 11,338,423 B2
(45) Date of Patent: May 24, 2022

(54) SLAP HAMMER WITH CAP DISPENSER

(71) Applicant: PNEUTOOLS, INC., Arlington, TN (US)

(72) Inventors: Frederick William Lamb, Sr., Mcdonald, PA (US); Frederick William Lamb, II, Carnegie, PA (US); Adam Greenawalt, Pickerington, OH (US)

(73) Assignee: PNEUTOOLS, INC., Arlington, TN (US)

( * ) Notice: Subject to any disclaimer, the term of this patent is extended or adjusted under 35 U.S.C. 154(b) by 200 days.

(21) Appl. No.: 16/566,406

(22) Filed: Sep. 10, 2019

(65) Prior Publication Data

US 2020/0078915 A1 Mar. 12, 2020

Related U.S. Application Data

(60) Provisional application No. 62/728,999, filed on Sep. 10, 2018.

(51) Int. Cl.
*B25C 5/16* (2006.01)
*B25C 5/11* (2006.01)

(52) U.S. Cl.
CPC ..... *B25C 5/1693* (2013.01); *B25C 5/11* (2013.01)

(58) Field of Classification Search
CPC ..... B25C 5/11; B25C 5/1693; B25C 5/1696; B25C 7/00; B25C 1/02; B25C 1/006; E04D 2015/045
USPC ..... 227/15, 16, 18, 135, 136
See application file for complete search history.

(56) References Cited

U.S. PATENT DOCUMENTS 2,963,706 A * 12/1960 Namanny ..... B25D 1/005 227/127
3,595,460 A * 7/1971 Pitkin ..... B25C 1/006 227/32
3,734,377 A * 5/1973 Munn ..... B25C 1/006 227/120
5,634,583 A * 6/1997 McGuinness ..... B25C 1/006 227/119
6,145,725 A * 11/2000 Omli ..... B25C 1/003 227/18
6,508,392 B1 * 1/2003 Huang ..... B25C 5/1693 227/119
6,550,660 B1 * 4/2003 Chlebowski ..... B25C 5/11 227/131
6,966,389 B1 * 11/2005 Riggs ..... B25C 5/11 173/1
7,232,050 B2 6/2007 Omli
(Continued)

*Primary Examiner* — Joshua G Kotis
(74) *Attorney, Agent, or Firm* — Reed Smith LLP

(57) ABSTRACT

A cap hammer for driving a staple through a cap into a work surface. The cap hammer includes a staple magazine configured to hold a plurality of staples, a cap magazine disposed beneath the staple magazine and configured to hold a horizontal stack of caps, an internal guide body disposed at a forward end of the cap hammer, a cap driver blade disposed within the internal guide body configured to shear a cap from the stack of caps, a staple driver blade disposed within the internal guide body configured to shear a staple from the plurality of staples, and a work contact element disposed at the forward end of the cap hammer and configured to activate the cap driver blade and the staple driver blade when depressed against a work surface.

5 Claims, 36 Drawing Sheets

(56) References Cited

U.S. PATENT DOCUMENTS

| | | | | |
|---|---|---|---|---|
| 7,506,789 | B2 * | 3/2009 | Shor | B25C 5/1693 227/147 |
| 8,146,789 | B2 | 4/2012 | Hu et al. | |
| 8,561,868 | B2 | 10/2013 | Shor | |
| 2003/0192930 | A1 | 10/2003 | Lamb | |
| 2004/0118732 | A1 * | 6/2004 | Lee | B25C 5/1693 206/445 |
| 2004/0149770 | A1 * | 8/2004 | Huang | B23P 19/001 221/268 |
| 2007/0164076 | A1 * | 7/2007 | Vanden Berg | B25C 5/1693 227/133 |
| 2008/0173690 | A1 | 7/2008 | Lamb | |
| 2019/0039222 | A1 * | 2/2019 | Wang | B25C 5/161 |

* cited by examiner

SLAP HAMMER WITH CAP DISPENSER

CROSS-REFERENCE TO RELATED APPLICATION

This application claims the benefit under 35 U.S.C. § 119(e) of the earlier tiling date of U.S. Provisional Patent Application No. 62/728,999 filed on Sep. 10, 2018 the disclosure of which is incorporated by reference herein.

BACKGROUND

This application discloses an invention which is related, generally and in various embodiments, to manual staplers, and in particular, to manual staplers for inserting staples into fastener caps intended to be used as a washers for holding roofing paper, insulation wrap, and coverings to houses, lumber, and other articles in the construction industry.

Plastic fastener caps washers are often used to hold down roofing paper, insulation wrap, and coverings on houses, buildings, lumber, and other structures in the construction industry. Often powered nail guns and staplers are used to drive staples and the like through the fastener caps. In some applications, unpowered manual staplers and palm nailers are used to drive staples and nails into the fastener caps. So-called "slap hammers" are known in the prior art that have a magazine of staples that are applied one by one to fasten insulation wrap, rooting paper, and the like to structures. In use, a slap hammer is held in a worker's hand and swung in an are toward the workpiece. When the nose of the slap hammer strikes ("slaps") the workpiece, the inertia of the head of the slap hammer causes a driver blade to drive the leading staple from the staple magazine into the workpiece. An advantage of slap hammers is that they are unpowered and also that staples can rapidly be applied to a workpiece by repeated swings of the slap hammer. A known slap hammer includes a magazine of fastener caps at the front end of the slap hammer in addition to the magazine of staples. The prior art front end magazine design suffers from impact that leads to premature failure of parts. The prior art design also requires the removal of the front end magazine to access the staple magazine. The prior art design also has a pivot point at the rear end of the slap hammer which requires extra force to drive a staple through a fastening cap. An example of a prior art slap hammer is disclosed in U.S. Patent Application Publication No. 2008/0173690, the disclosure of which is incorporated by reference herein.

Also, known cap slap hammers use feeder paws to advance their caps either manually or with complex feeding mechanisms that are prone to failure and are not strong. An example of cap feeding is found in U.S. Patent Application Publication No. 2003/0192930A1, the disclosure of which is incorporated by reference.

It is therefore desirable to have a slap hammer that does not have the disadvantages of the prior art slap hammers.

DETAILED DESCRIPTION

Figure 1:
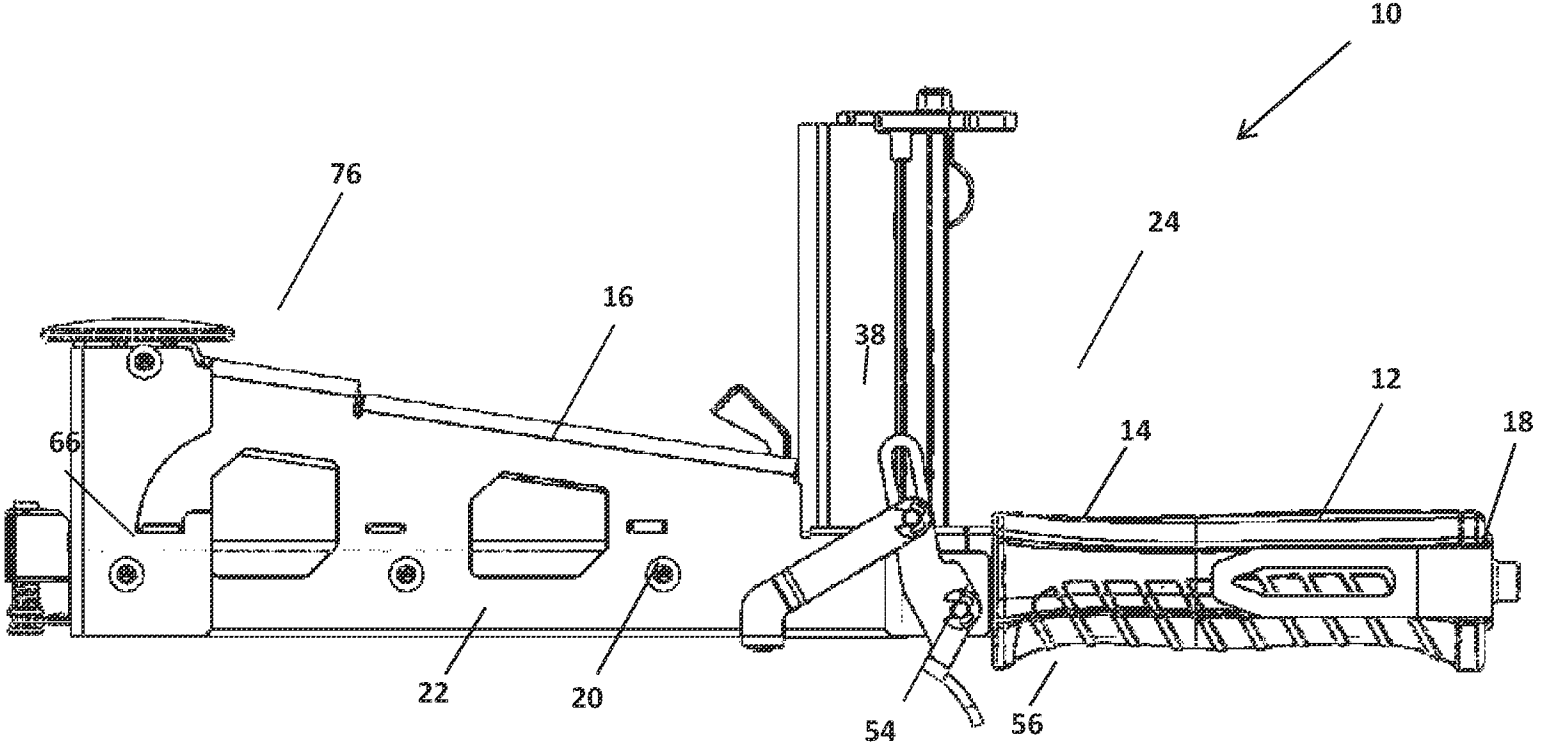
FIG. 1 shows a first side view of a cap hammer according to a first embodiment.
Figure 2:
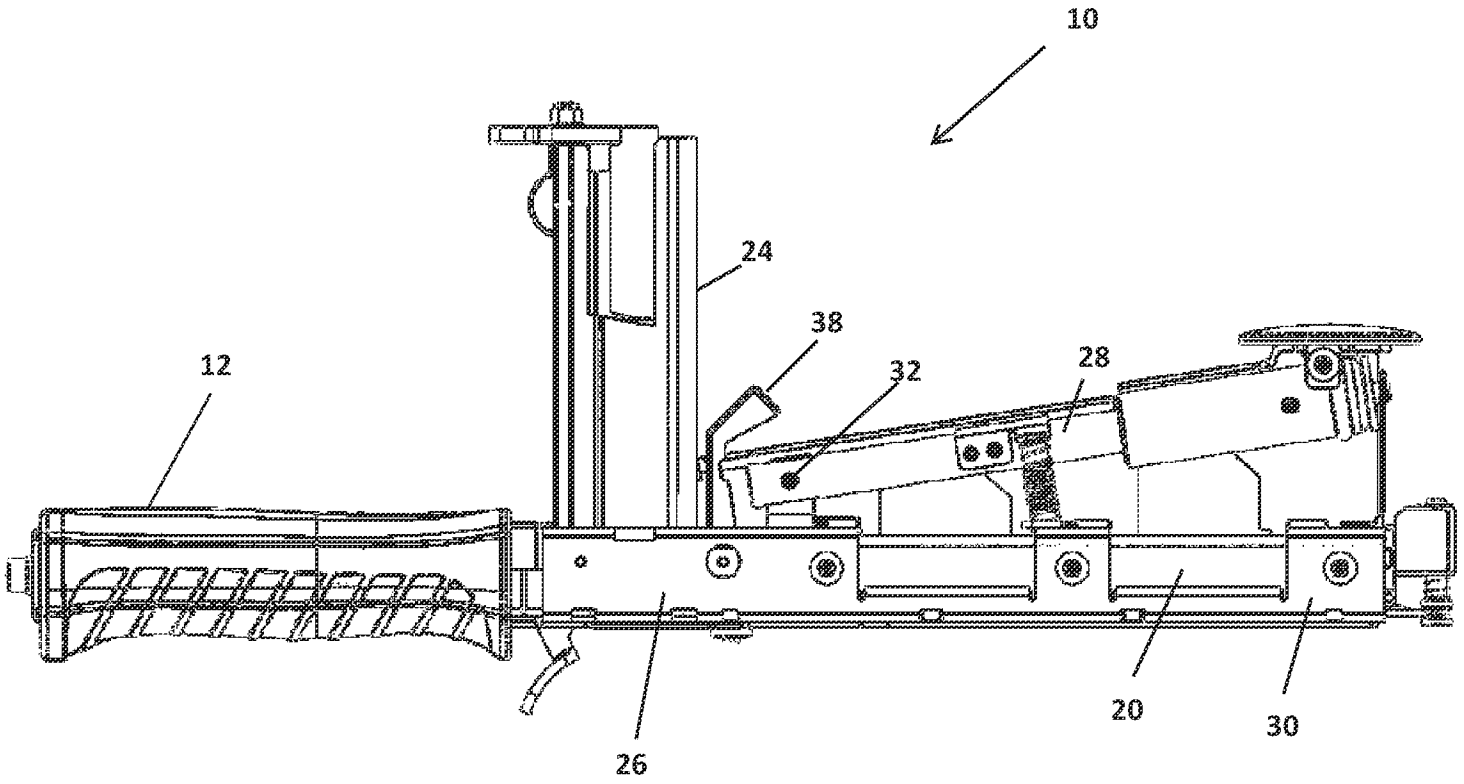
FIG. 2 shows a second side view of the cap hammer of FIG. 1.
Figure 3:
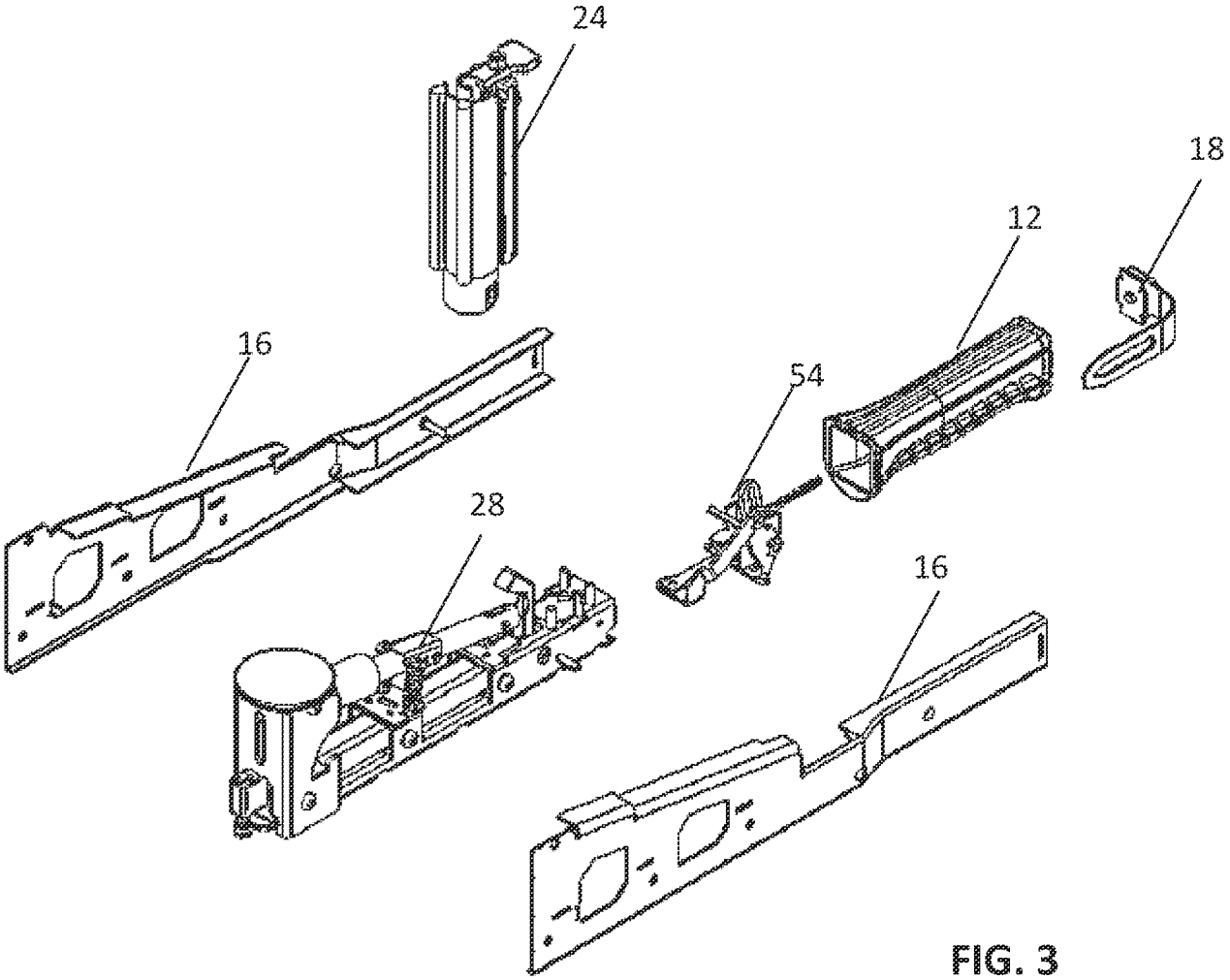
FIG. 3 shows a partially exploded view of the cap hammer of FIG. 1.
Figure 4:
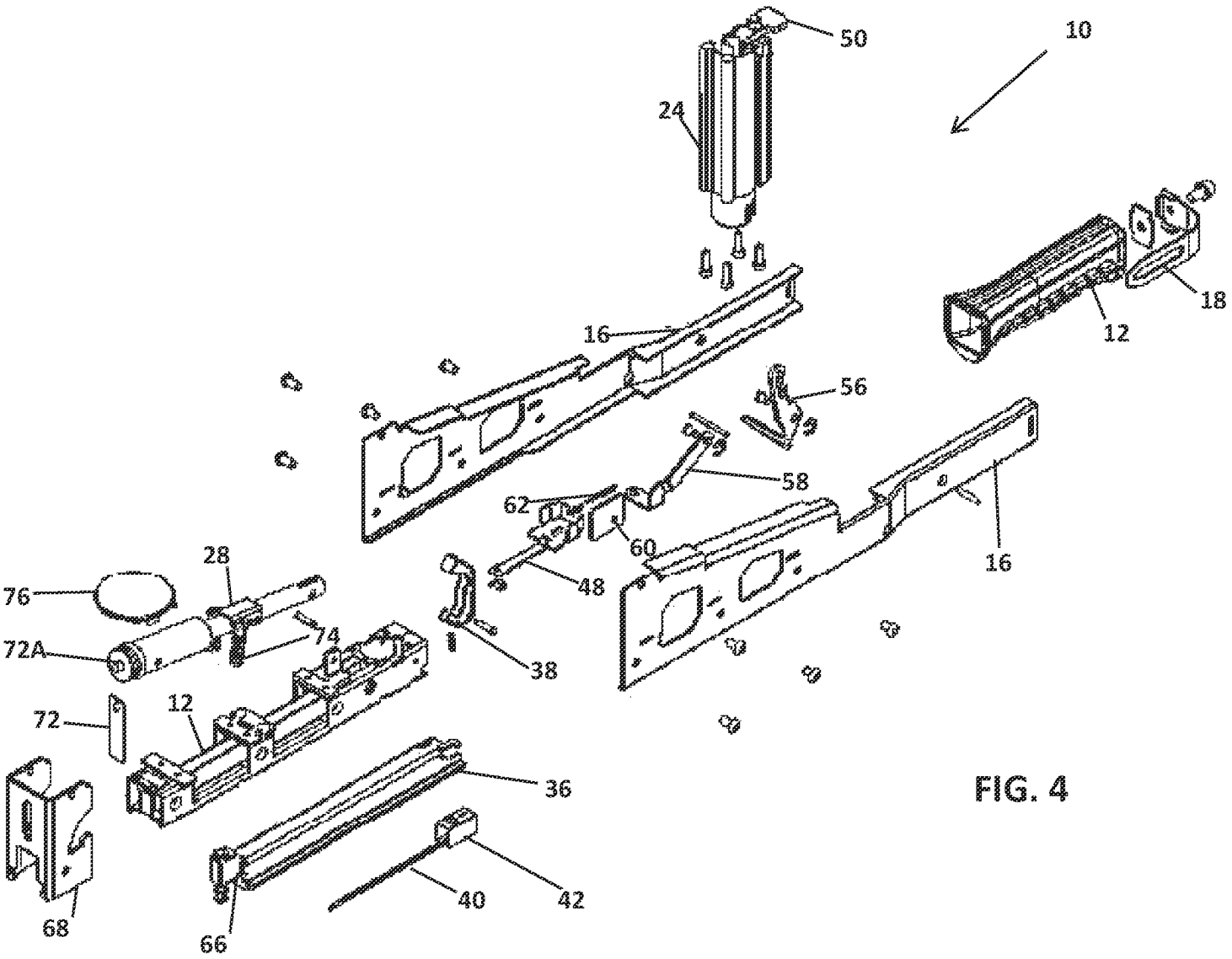
FIG. 4 shows an exploded view of the cap hammer of FIG. 1.
Figure 6:
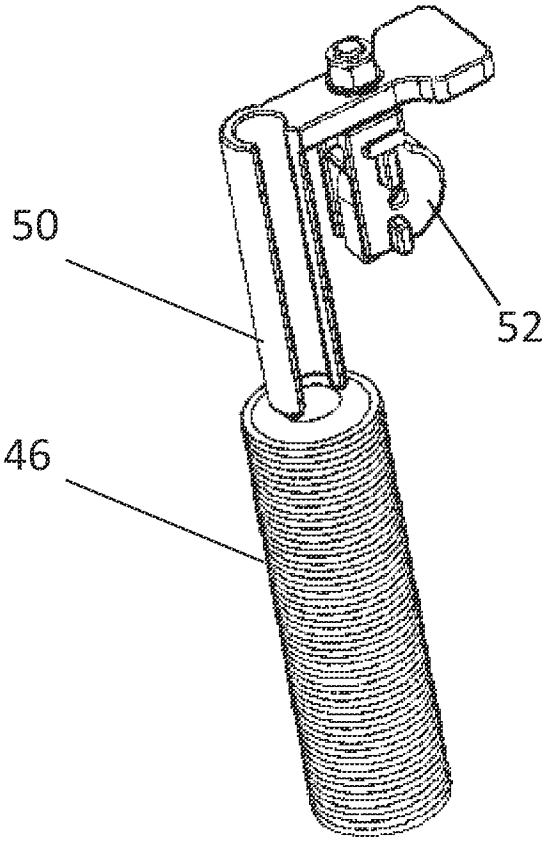
FIG. 6 shows an interior view of FIG. 5.
Figure 5:
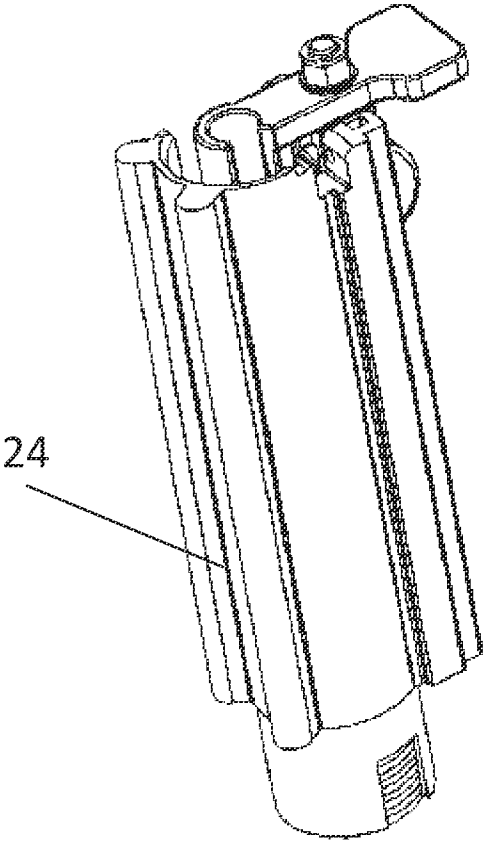
FIG. 5 shows a perspective view of the cap tower of the cap hammer of FIG. 1.
Figure 7:
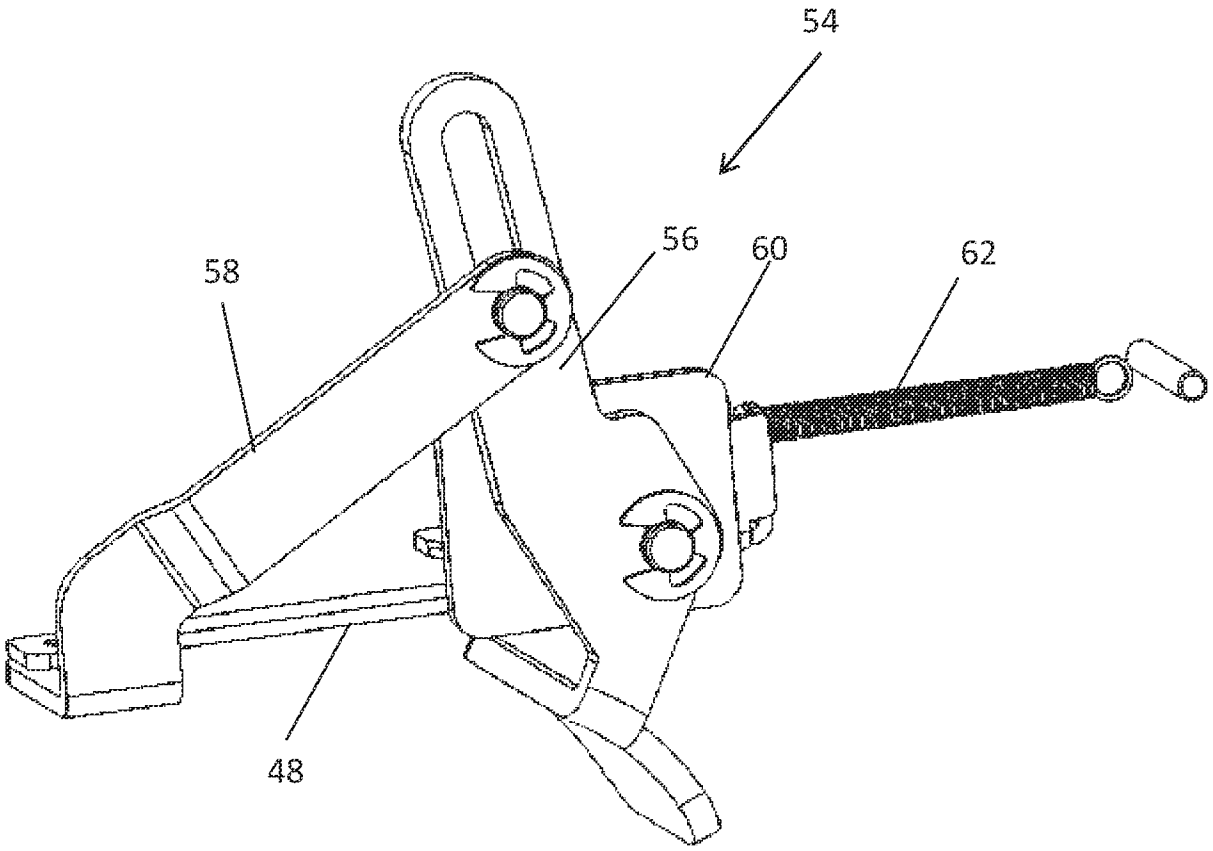
FIG. 7 shows a side view of trigger assembly of the cap hammer of FIG. 1.
Figure 8:
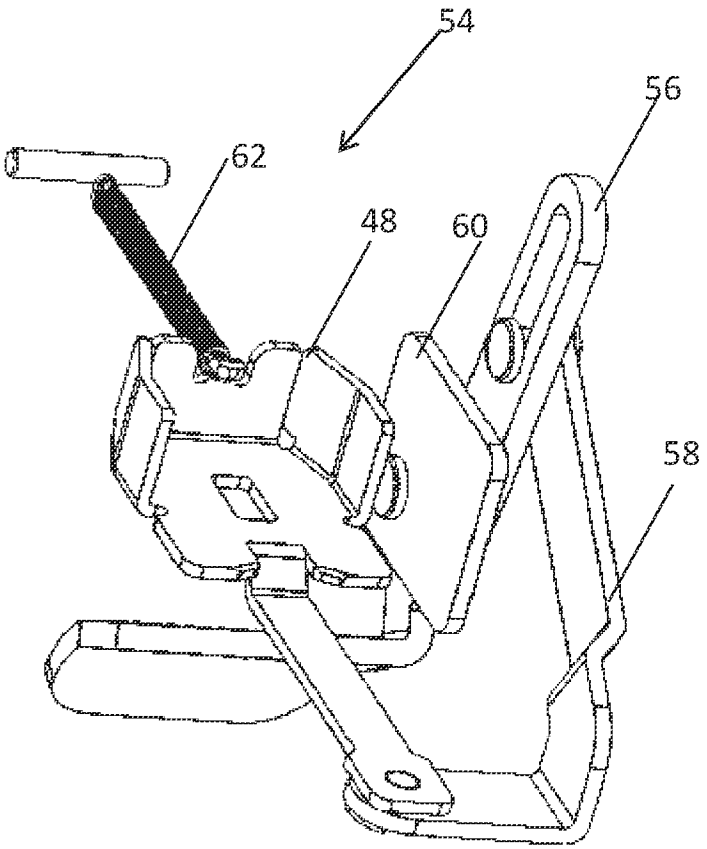
FIG. 8 shows a perspective view of trigger assembly of the cap hammer of FIG. 1.
Figure 9:
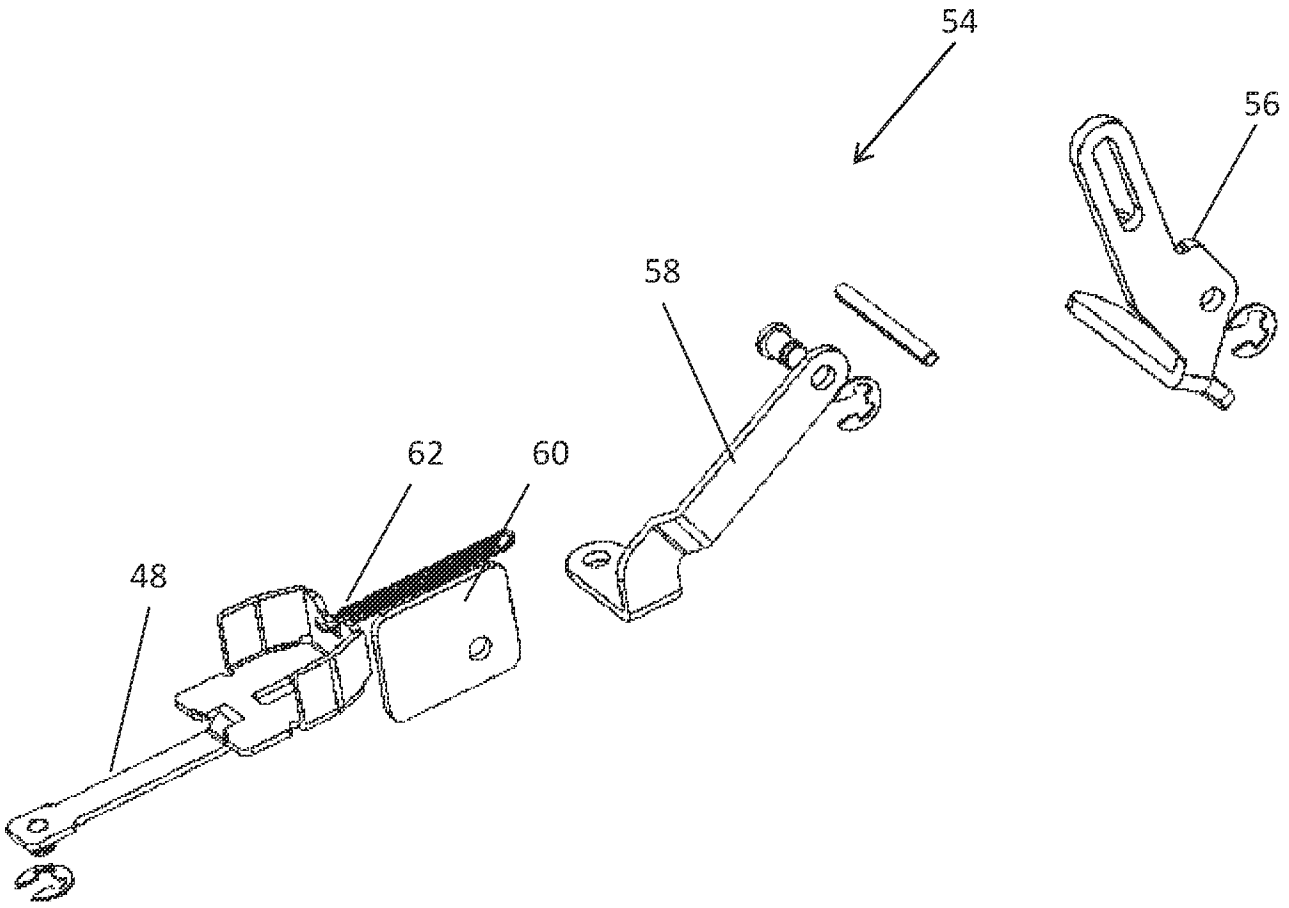
FIG. 9 shows an exploded view of trigger assembly of the cap hammer of FIG. 1.
Figure 10:
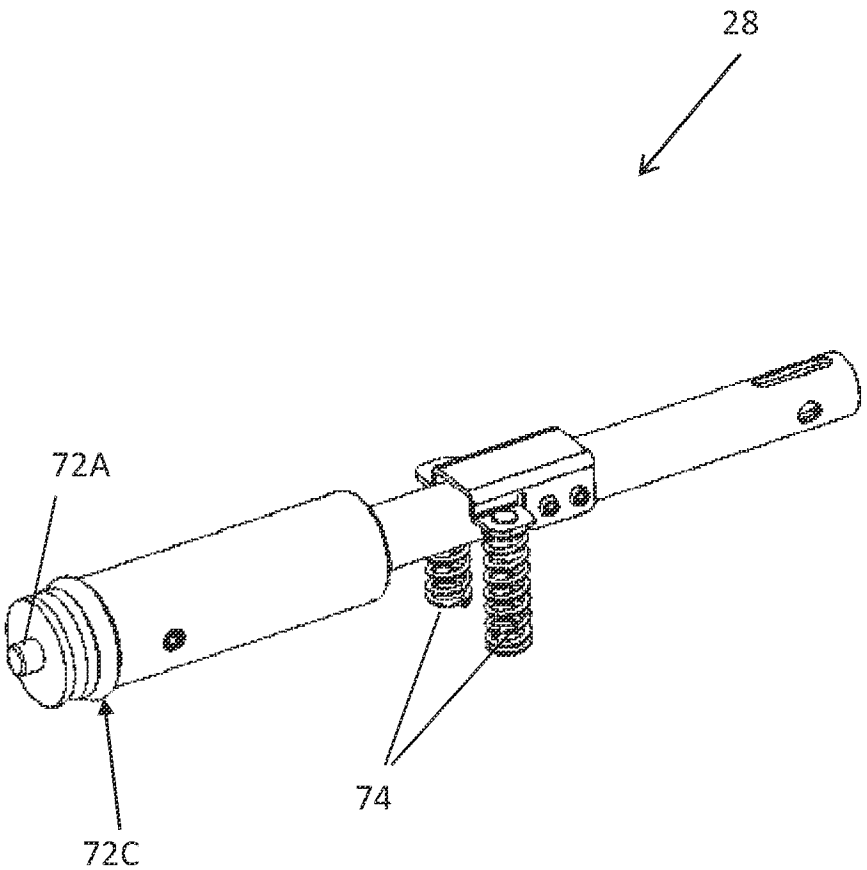
FIG. 10 shows a perspective view of the piston drive assembly of the cap hammer of FIG. 1.
Figures 11A, 11B:
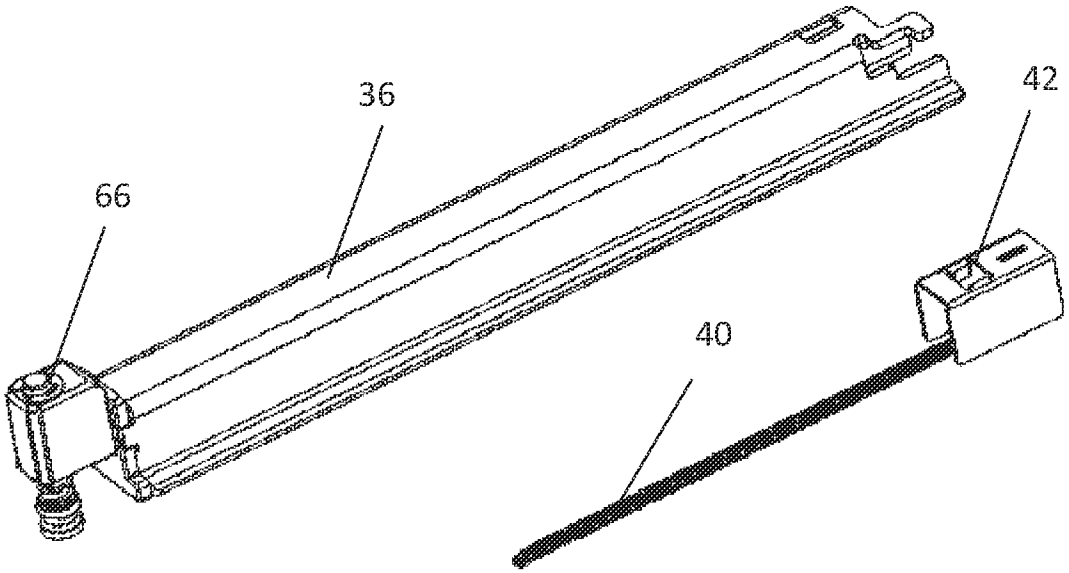
FIG. 11A shows a perspective view of the moving outer magazine rail of the cap hammer of FIG. 1.
FIG. 11B shows a perspective view of the staple spring and follower of the cap hammer of FIG. 1.
Figure 12:
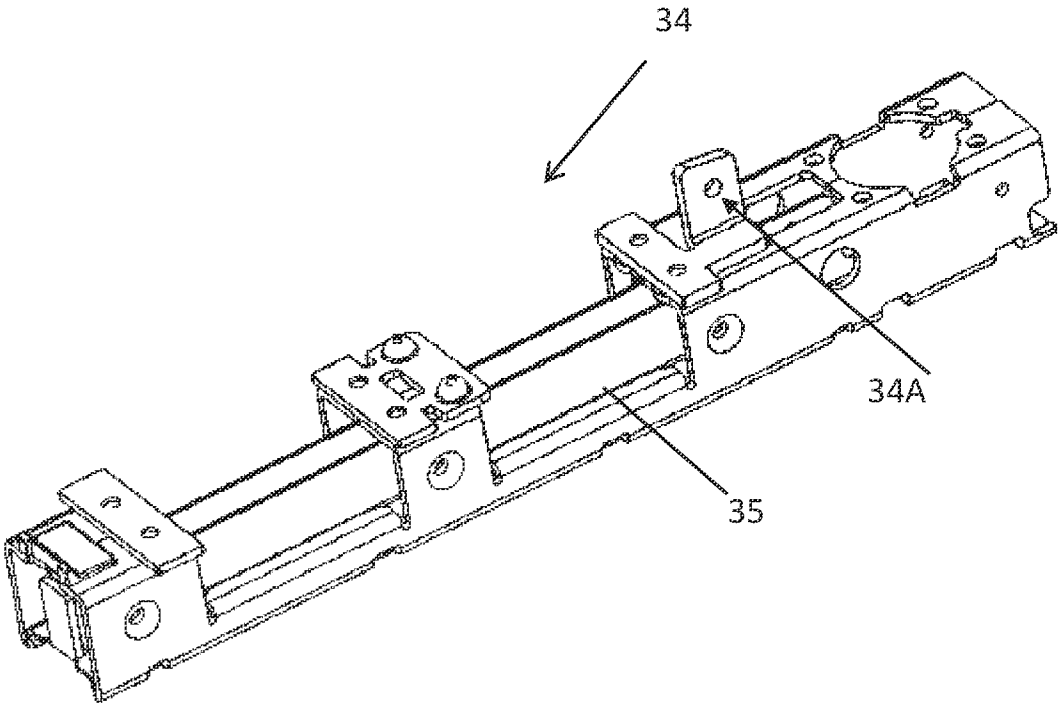
FIG. 12 shows a perspective view of the of the internal magazine housing of the cap hammer of FIG. 1.
Figure 13:
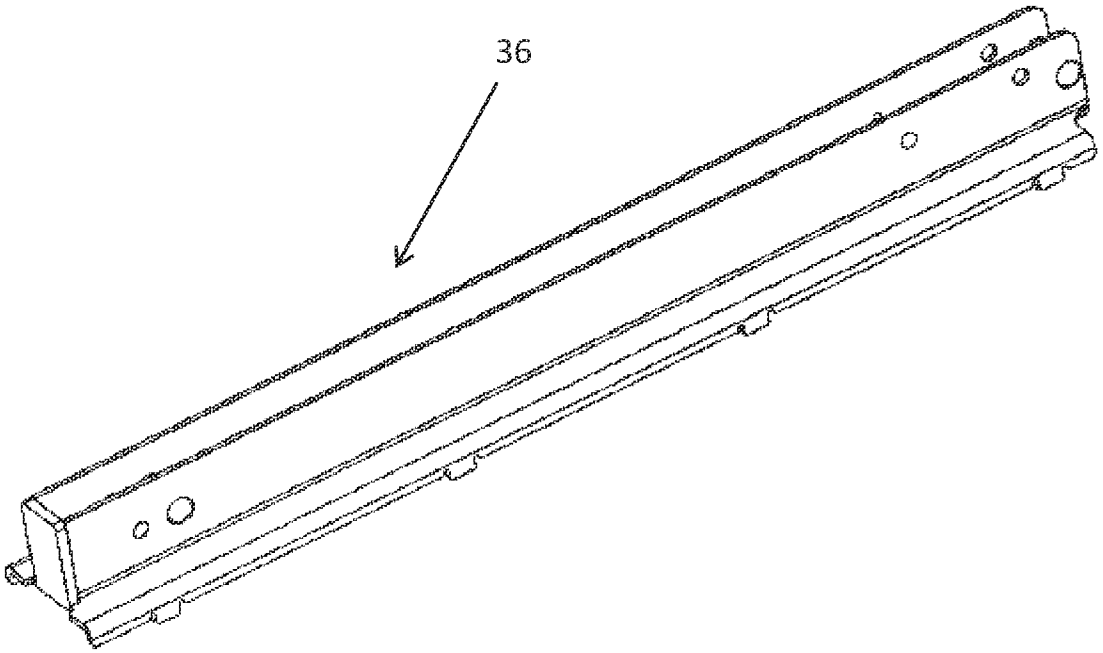
FIG. 13 shows a perspective view of the internal magazine of the cap hammer of FIG. 1.
Figure 15:
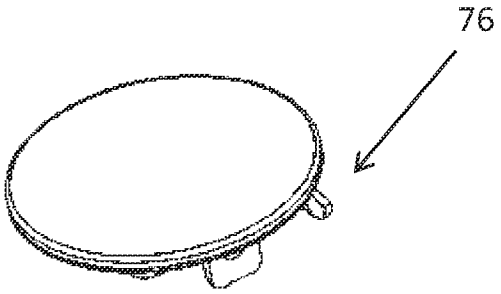
FIG. 15 shows a top perspective view of the hammer head of the cap hammer of FIG. 1.
Figure 16:
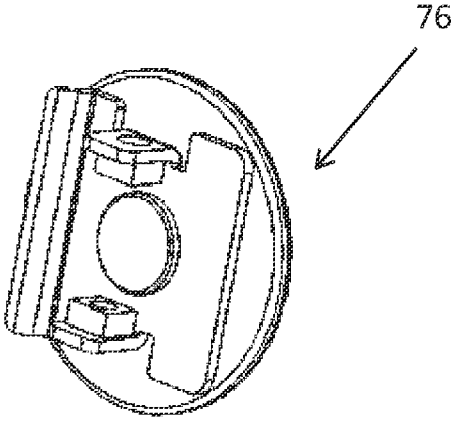
FIG. 16 shows a bottom perspective view of the hammer head of the cap hammer of FIG. 1.

Referring to FIGS. 1-19, cap hammer 10 includes a handle 12 attached to the rear end 14 of an external housing 16. Handle 12 may include a belt hook assembly 18 for attaching to a user's belt. A staple magazine 20 is housed within external housing 16 at a forward end 22 thereof. A Fastener cap magazine or tower 24 is disposed at a rear end 26 of staple magazine 20 just forward of handle 12. A weighted piston drive assembly 28 is disposed above the forward end 30 of staple magazine 20 in external housing 16 and is pivotally connected to a mounting bracket 34A disposed on an internal magazine housing 34 of staple magazine 20 at pivot point 32 for up and down movement relative to staple magazine 20.

Figure 14:
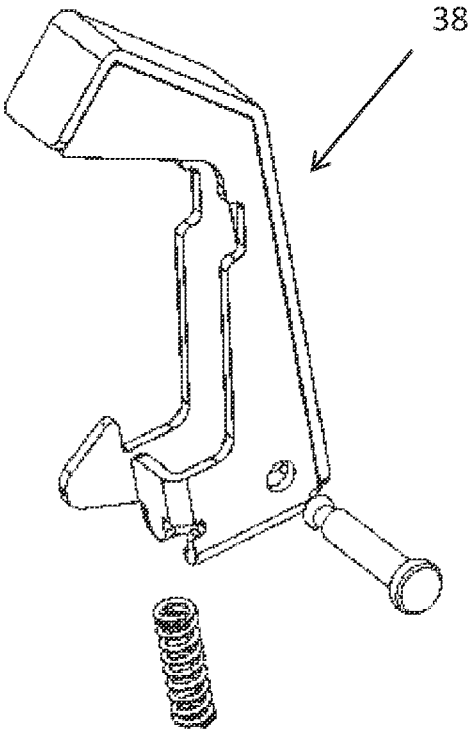
FIG. 14 shows a perspective view of the staple magazine latch of the cap hammer of FIG. 1.
Figure 17:
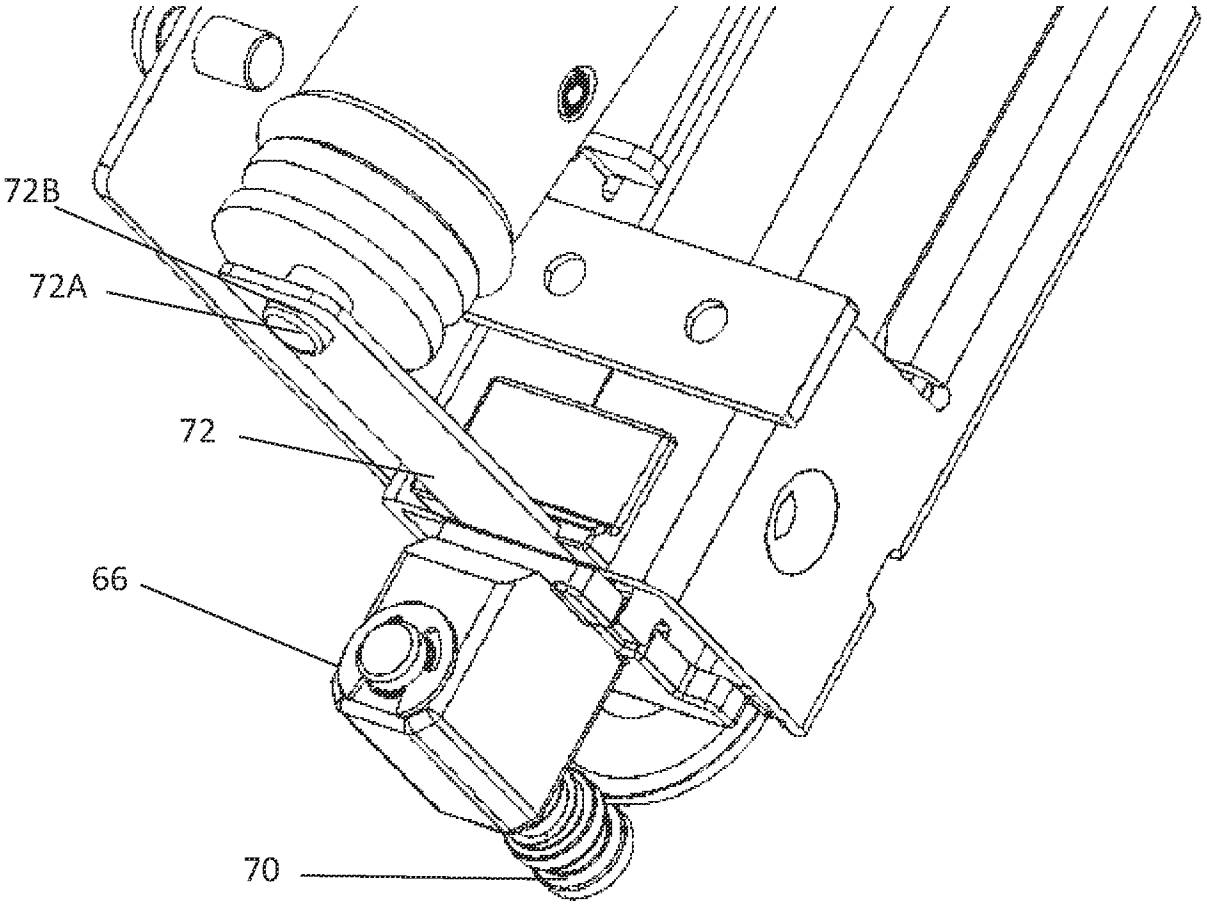
FIG. 17 shows a detail perspective view of the front end of cap hammer of FIG. 1.
Figure 18:
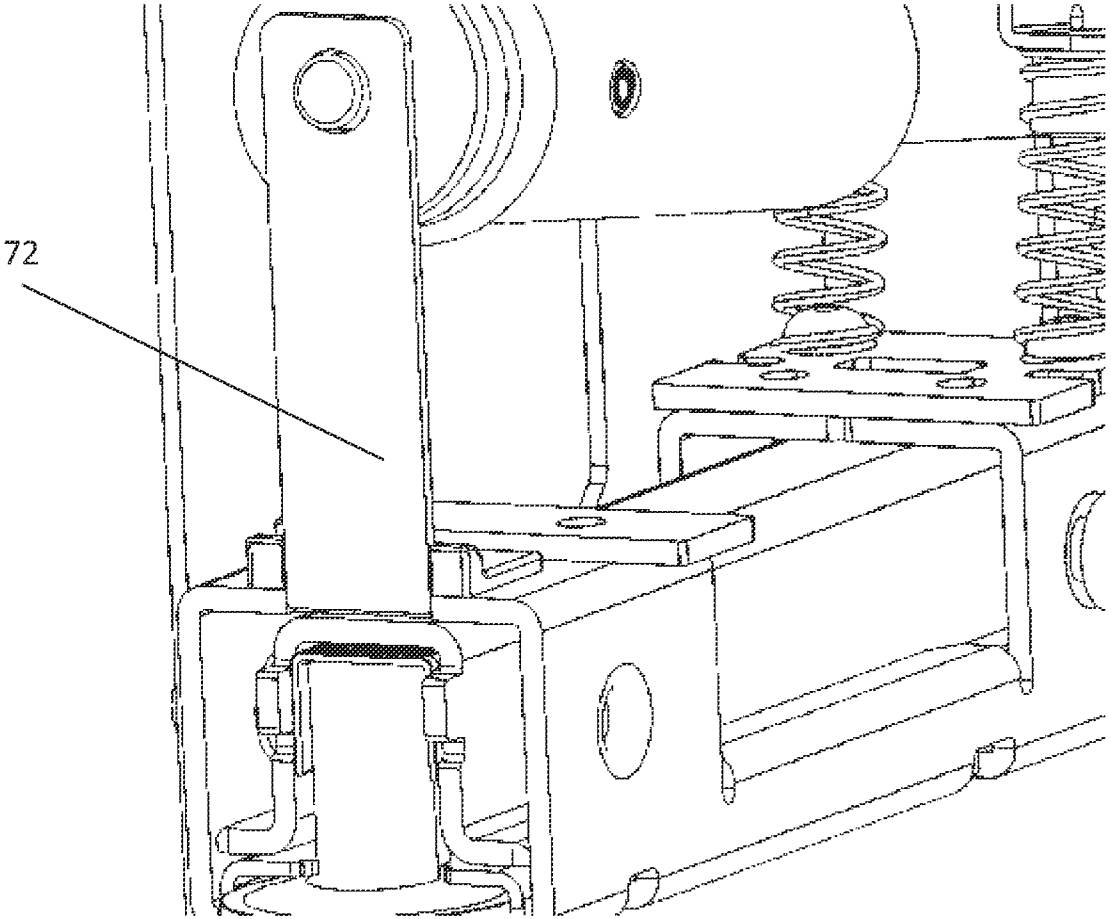
FIG. 18 shows another detail perspective view of the front end of cap hammer of FIG. 1 with some parts removed.
Figure 19:
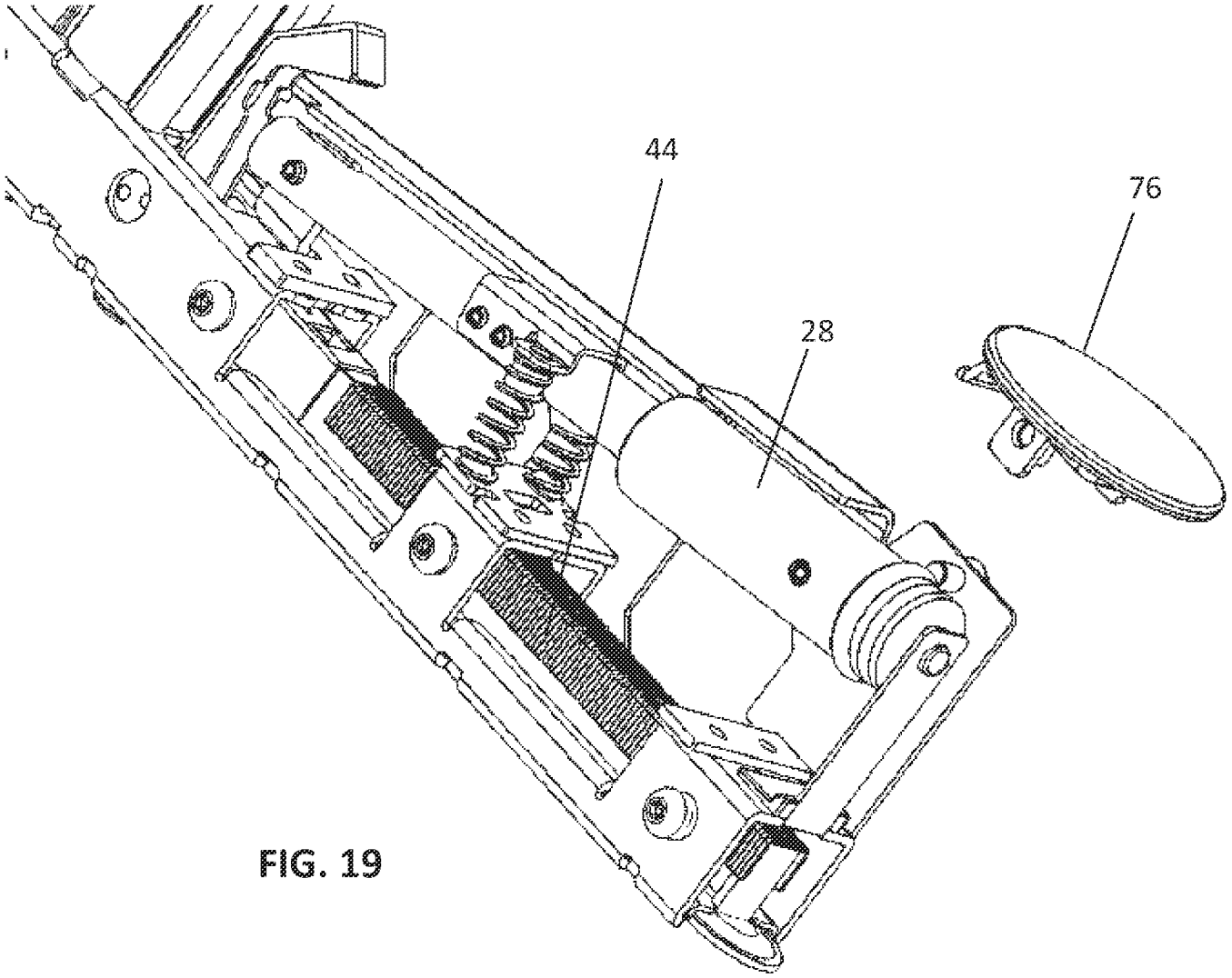
FIG. 19 shows a side perspective view of the cap hammer of FIG. 1 with some parts removed.

Staple magazine 20 includes the internal magazine housing 34 (FIG. 12), an internal magazine 35 (FIG. 13), a moving outer magazine rail 36 (FIG. 11A), a staple spring 40 and pusher 42 (FIG. 11), and a staple magazine latch 38 (FIG. 14). The user begins to use the cap hammer 10 by loading staples 44 into moving outer magazine rail 36. To load staple magazine 20, the user pushes forward on the staple magazine latch 38, which releases the moving outer magazine rail 36 that is nested inside of internal magazine housing 34. The user then pulls on a cap stop 66 near the nose of the cap hammer 10, and the staple magazine 20 comes out of the front of the cap hammer 10. Cap stop 66 on front of the nose 68 of cap hammer 10 allows for loose caps 46 to be used. A cap stop spring 70 allows for increased part life on front of cap hammer 10. The user places a strip of staples 44 in the bottom of moving outer magazine rail 36, and pushes it back into the front of internal magazine housing 34 until it latches closed. This is a front load procedure on cap hammer 10, meaning that staples 44 are inserted from the front of cap hammer 10, instead of the back.

The front load staple procedure with the moving outer magazine rail 36 design of the cap hammer 10 allows for multiple benefits. Caps 46 do not have to be removed from their cap magazine 24 to load the staples. Caps 46 are located out of the way of the staple loading zone, reducing complexity of the load. It allows for a more compact, durable and cost effective design.

To continue, the user then loads caps 46 into the cap magazine 24 by pulling up on a pusher follower 50 that is in the cap magazine 24. Once the pusher follower 50 is up and out of the cap magazine 24, the user loads a stack of caps 46 into cap magazine 24. They then place the pusher follower 50 back in the top of cap magazine 24, which held by a magazine spring 52, puts pressure down on the top of the cap stack 46 and keeps them firmly in place.

The cap magazine 24 design has multiple benefits.

1) The cap magazine 24 is a compact design that allows for central placement of the cap magazine 24 on the cap hammer 10.

2) This central placement allows for a more balanced feel of cap hammer 10, instead of having the weight of the caps and magazine at the back of the cap hammer 10.

3) This central placement increases centrifugal rotation around the axis of the tool, which increases force of impact with the tool while decreasing effort needed by the end user.

4) Internal magazine housing 34 design and cap magazine 24 design allows for two part external housing design for a solid product construction to increase durability.

5) Cap magazine 24 position allows for frontload of staples 44 and allows user to remove staples 44 without removing caps 46.

6) Cap magazine 24 of welded caps 46 allows for no lost caps 46 and no wastage by preventing caps 46 from escaping cap magazine 24.

7) Centered cap magazine 24 position increases durability while front of tool cap magazines suffer from impact that leads to premature failure of parts.

8) Spring loaded cap magazine 24 and pusher follower prevent jams and keep users from loading caps upside down.

A trigger assembly 54 disposed with external housing includes a first trigger link 56, a second trigger link 58, a trigger guide 60, a trigger spring 62 and a cap shear and driver 48. For first using the cap hammer 10 after loading the staples 44 and caps 46, the user will prime cap hammer 10 by pulling on first trigger link 56 until cap magazine 24 is full of caps 46 and they can no longer pull first trigger link 56.

The cap 46 is held in place by a cap stop 66 at the end of the moving outer magazine rail 36. When the cap hammer 10 is swung onto a surface, a driver blade 72 that is attached to weighted piston driver assembly 28 responds to the change of direction of force and slams down onto the top of the staple 44. The staple 44 shears from its collated position and is driven through the top of the cap 46 into the work surface. Two return springs 74 attached to weighted piston driver assembly 28 send the weighted piston driver assembly 28 back to its original position at the top of its stroke, ready to drive a staple 44 again. Loosely attached driver blade 72 moving in are motion at the top of the driver blade on the driver blade pin 72A prevents stress on driver blade 72 and enables short arcing pivot point from the middle of the tool, which increases durability and reduces force needed for driving fasteners.

The design of the weighted piston driver assembly 28 has multiple benefits:

1) The driver blade pin 72A on the front of the weighted piston driver assembly 28 is loosely fitted through the driver blade hole 72B, which allows the driver blade pin 72A to pivot in an arcing motion through the hole 72B of the driver blade 72. This motion allows the driver blade 72 to slide up and down in the driver guide 78, and not get pinched or jammed.

2) The design allows for a shortened design that places the pivot point 32 in front of the end users hand, instead of behind the end users hand.

3) This pivot point 32 placement reduces the effort needed to drive a staple 44 and reduces shock to the end user.

4) It reduces shock transferred to the end user.

5) It creates a centrifugal driving motion that focuses the energy of the tool into the front and reduces the force needed to drive the staples 44.

6) Weighted piston assembly design with centered placement of the pivot point 32 of the cap hammer 10 in front of the users hand allows for higher stroke position to enable autofeeding of caps 46.

The user, after driving a cap raises the cap hammer 10 from the surface and again pulls first trigger link 56 of trigger assembly 54. The trigger assembly 54 works by the user pulling first trigger link back 56. First trigger link 56 is attached to second trigger link 58 and the trigger guide 60, which are attached to the cap shear and driver 48. First trigger link 56 moves forward and down at the connection of second trigger link 58 as it is being pulled up. Then second trigger link 58 is pushed forward and down and that movement pulls the cap shear and driver 48 forward, which shears a cap 46 from the bottom of the welded cap stack. The loose cap 46 is driven down the cap track and when the user releases first trigger link 56 then the trigger spring 62 attached to the cap shear and driver 48 pulls all of the linkage assembly 54 hack into place, which resets for being used again.

Cap hammer 10 preferably has a hammer head 76 on front acts as a weight to center pivot point 32 of the cap hammer 10, creating a more balanced feel that requires less force from the end user to drive a staple 44. The nose design and external housing design of the cap hammer 10 allow for the cap hammer 10 to have hammer head 76 which is used for hammering staples 44 and material. In other slap hammers, using the head of the tool as a hammer would fire a staple at the user. This design prevents a staple from being fired at the user while being used as a hammer.

Cap hammer 10 has no external moving driver or parts so that there is much greater durability. Length of the cap hammer 10 reduces force needed to drive a staple 44 through a cap 46 and into a work surface which reduces shock which increases durability of the cap hammer 10 and reduces shock transferred into the hand and arm of the user. The centered pivot point 32 and overall tool balance reduces the need for extra force to drive a staple 44 through a cap 46 into a work surface which reduces shock and increases durability of the cap hammer 10 and also reduces shock transferred into the hand and arm of the user.

The bumper 72C (FIG. 10) on the weighted piston driver assembly reduces shock, which increases durability of the cap hammer 10 and reduces shock transferred into the hand and arm of the user. The cap hammer 10 is designed for easily installing certain construction products, which reduces labor, and reduces cost, while increasing durability of the cap hammer 10. It has been designed to place a cap 46 on a work surface by driving a staple 44 through it.

If not otherwise stated herein, it may be assumed that all components and/or processes described heretofore may, if appropriate, be considered to be useable with or interchangeable with similar components and/or processes disclosed in the following embodiments, unless an express indication is made to the contrary. Reference may be made to the above description and FIGS. 1-19 for similar components and procedures described below.

Figure 36:
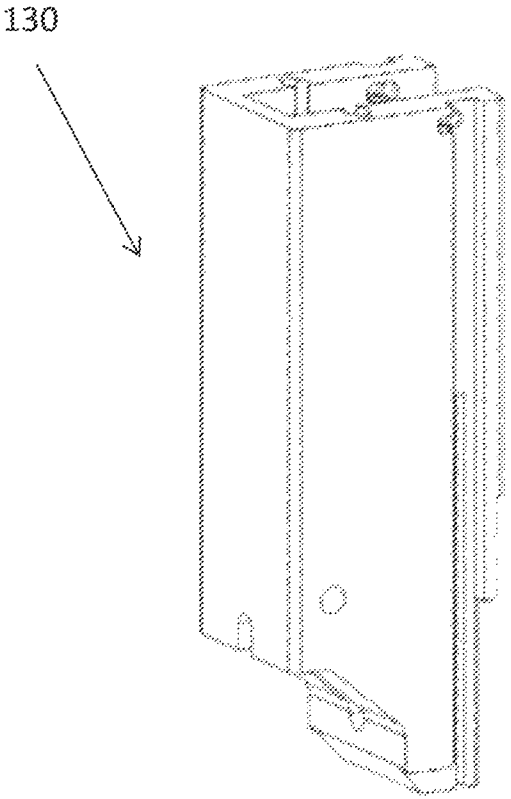
FIG. 36 shows a perspective view of the internal guide body of the cap hammer of FIG. 20.
Figure 34:
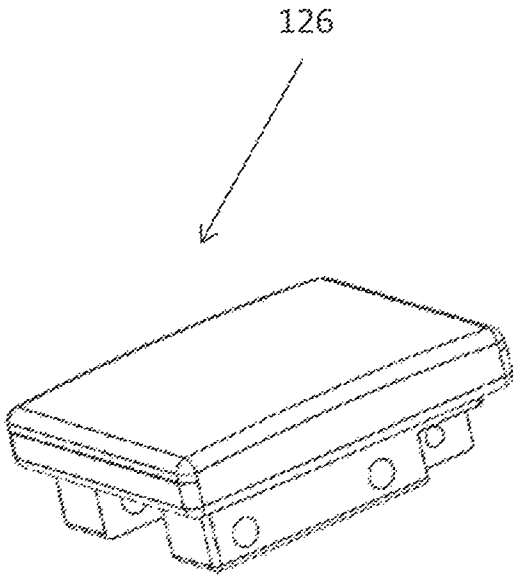
FIG. 34 shows a perspective view of the hammerhead of the cap hammer of FIG. 20.
Figure 35:
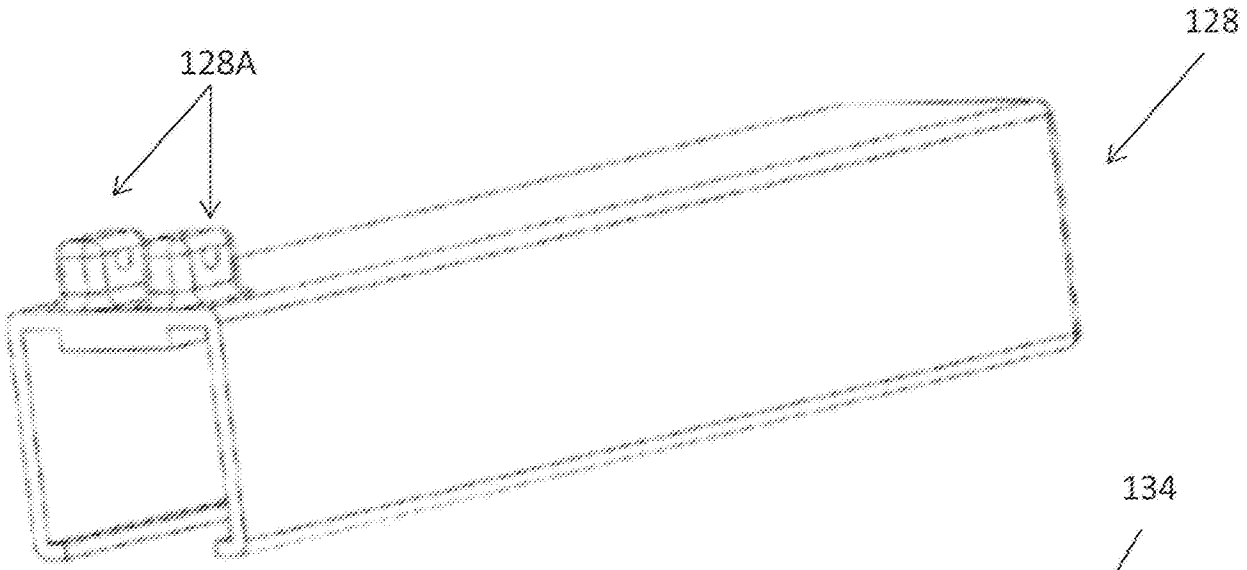
FIG. 35 shows a perspective view of the handle of the cap hammer of FIG. 20.
Figure 37:
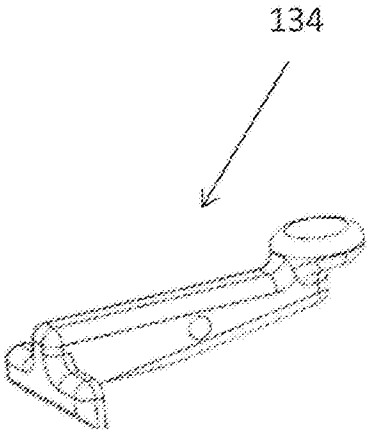
FIG. 37 shows a perspective view of the magazine latch of the cap hammer of FIG. 20.
Figure 38:
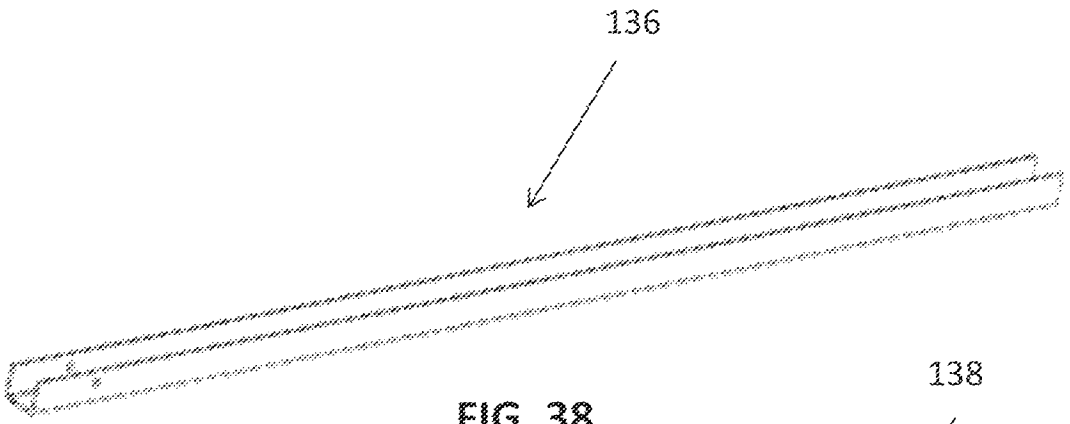
FIG. 38 shows a perspective view of the magazine rail of the cap hammer of FIG. 20.
Figure 39:
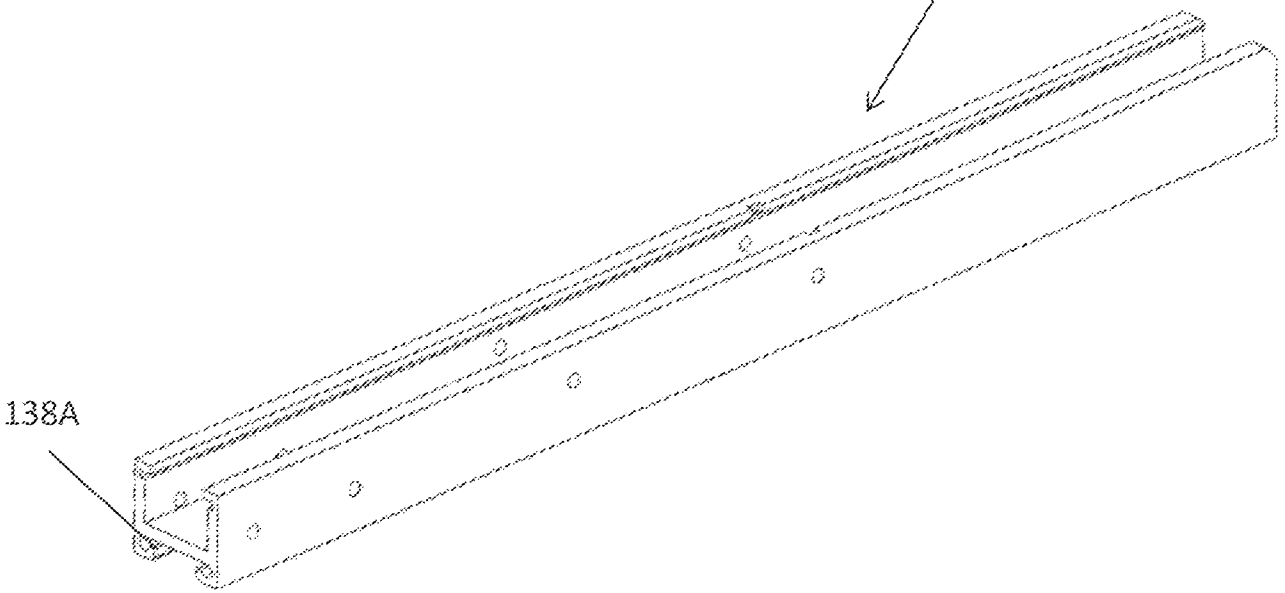
FIG. 39 shows a perspective view of the s main body of the cap hammer of FIG. 20.
Figure 43:
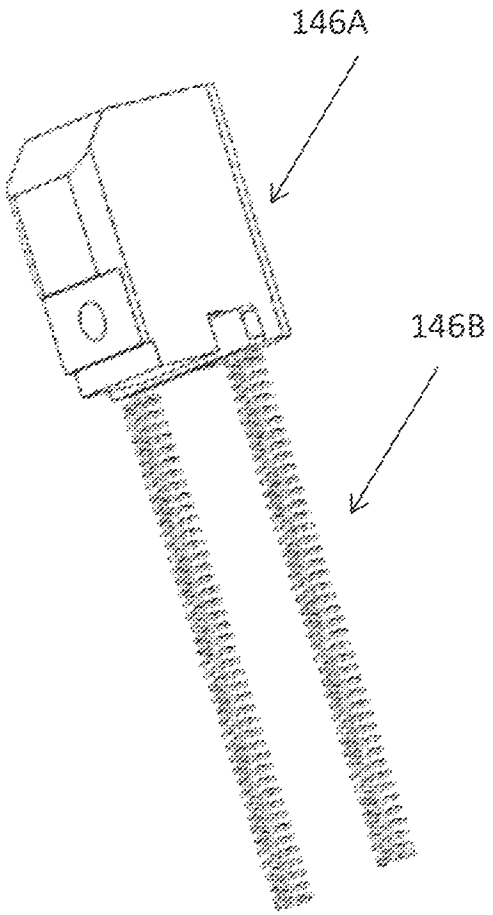
FIG. 43 shows staple driver weight and springs of the cap hammer of FIG. 20.
Figure 40:
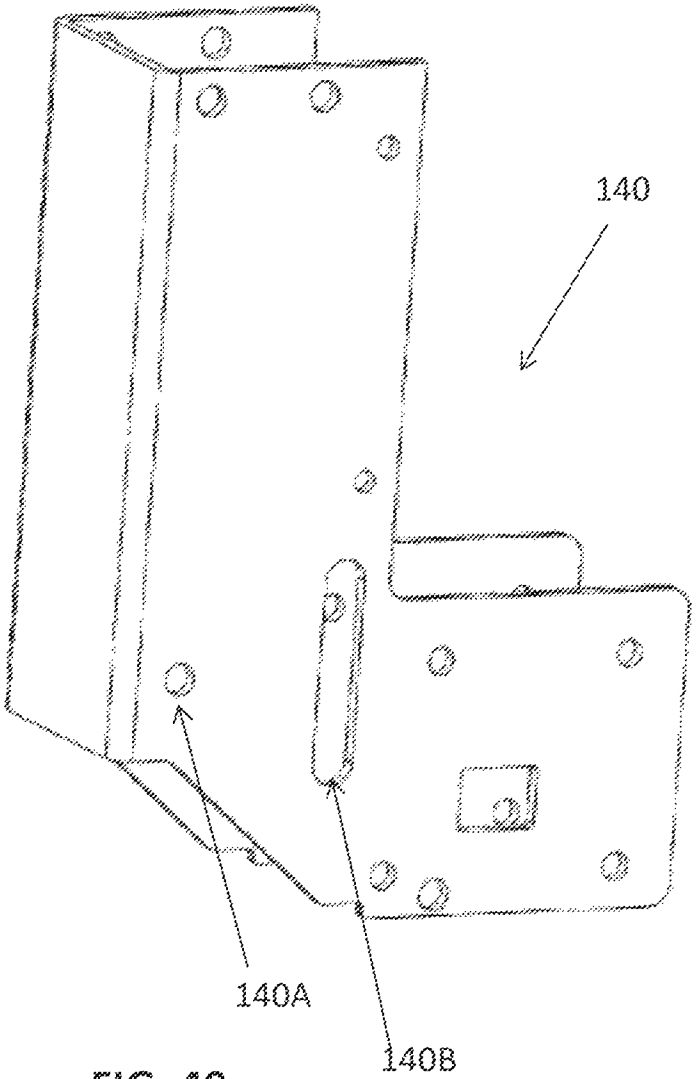
FIG. 40 shows a perspective view of the s main head cover of the cap hammer of FIG. 20.
Figure 41:
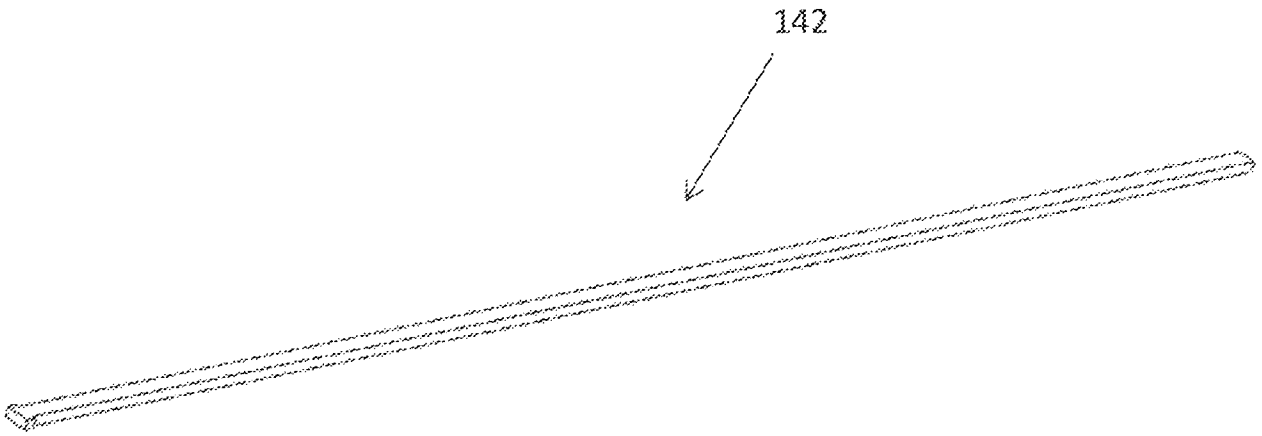
FIG. 41 shows a perspective view of the pusher retractor rod of the cap hammer of FIG. 20.
Figure 42:
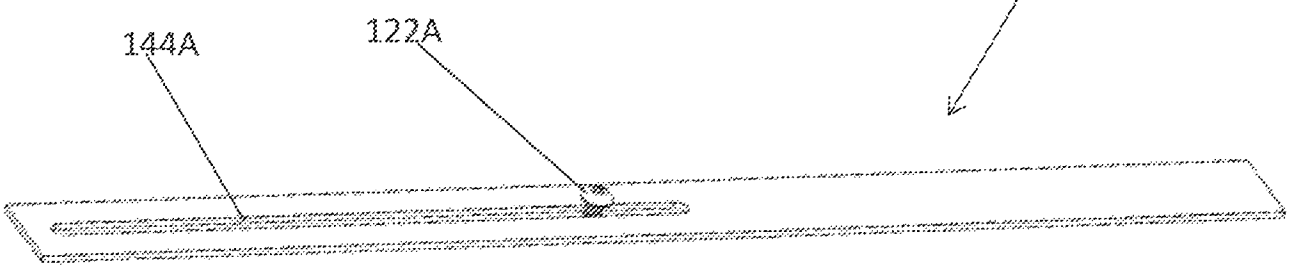
FIG. 42 shows a perspective view of the rail cover of the cap hammer of FIG. 20.

Referring to FIGS. 20-49, an alternative embodiment of a cap hammer 100 is shown. Cap hammer 100 includes a handle 128 disposed at the rear end of the cap hammer 100. A horizontal cap magazine 104 is disposed underneath a horizontal top-load staple magazine 135 at the forward end of cap hammer 100 just forward of handle 128. A main head cover 140 (FIG. 40) and back body cover 110 (FIG. 26) housing an internal guide body 130 (FIG. 36) is disposed at the forward end of staple magazine 135 and cap magazine 104. A cap driver blade 114A and a staple driver blade 120 are contained in the internal guide body 130 forming a two blade system. A hammer head 126 (FIG. 34) is disposed on top of main head cover 140 and back body cover 110.

Like cap hammer 10 discussed above, the cap hammer 100 is designed for easily installing certain construction products, which reduces labor, and reduces cost, while increasing durability of the tool. It has been designed to place a cap 46 on a work surface by driving a staple 44 through it.

Figure 32:
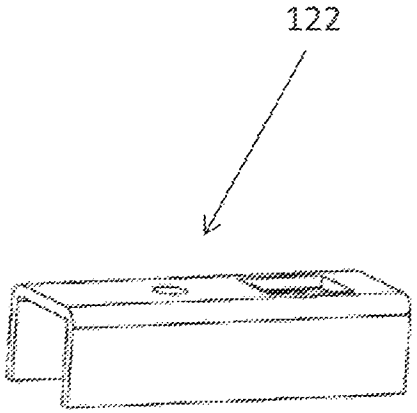
FIG. 32 shows a perspective view of the staple follower of the cap hammer of FIG. 20.
Figure 49:
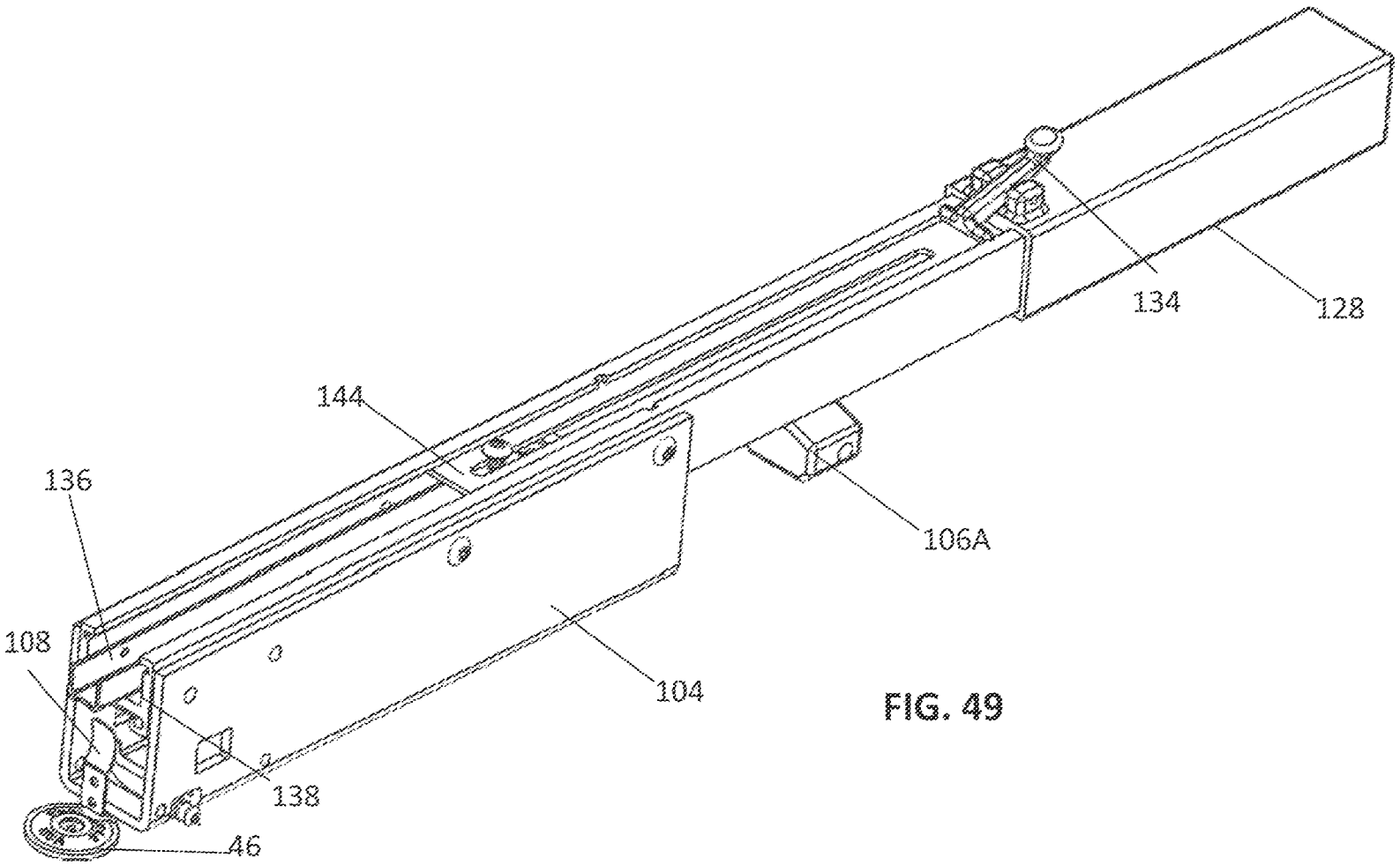
FIG. 49 shows a perspective view of the cap hammer of FIG. 20 with some of the front portion removed showing open double magazines.

The user begins to use the cap hammer by loading staples into the staple magazine 135. Staple magazine 135 includes a magazine rail 136 (FIG. 38), a main body 138 (FIG. 39), and a rail cover 144 (FIG. 42) having an elongated opening 144A. Magazine rail 136 is housed within the top of main body 138. Main body 138 further has a groove 138A on a bottom portion thereof. FIG. 32 shows staple follower 122. Staple follower 122 slides on top of magazine rail 136 and acts to push along the staples 44 by spring tension, which also slide along the top of the magazine rail 136. A spring 136A (FIG. 21C) resides inside of the magazine rail 136 and provides spring tension to the staple follower 122 and is attached at the other end to the inside of the magazine rail 136. Staple follower 122 has an allan screw 122A on the top portion thereof which is moveable within elongated opening 144A of rail cover 144. To load the magazine rail 136, the user depresses a magazine latch 134 which is pivotally connected to handle 128 at pivots 128A, and pulls horizontally backwards on the handle 128 (FIG. 35) which away from the head 100A of the cap hammer 100 (FIG. 49). Handle 128 is telescopically slidable on main rail 138 and attached to rail cover 144. This action pulls back the rail cover 144 (FIG. 42) and exposes the magazine rail 136 for insertion of staples 44 onto the magazine rail 136. This same action also pulls back a pusher retainer follower 106A (FIG. 24) which is connected to a pusher retractor rod 142 (FIG. 41), which rides in the bottom of the main body 138 (FIG. 40) in groove 138A and cap magazine 104 (FIG. 23) and is also connected to handle 128. At the end of its stroke back, the pusher retainer follower 106A exits the back of the cap magazine 104, and springs automatically to the side out of the way of the entrance to the back of the cap magazine 104 by means of springs 1061B (FIG. 24) inserted and captured in groove 138A. This allows the user to insert stacks of caps 46 into the cap magazine 104. The user then pushes the sprung open pusher retainer follower 106A back, and pushes the handle 128 closed towards the head of the cap hammer 100, which inserts the pusher retainer follower 106A back into the cap magazine 104 and then closes the rail cover 144

Figure 48:
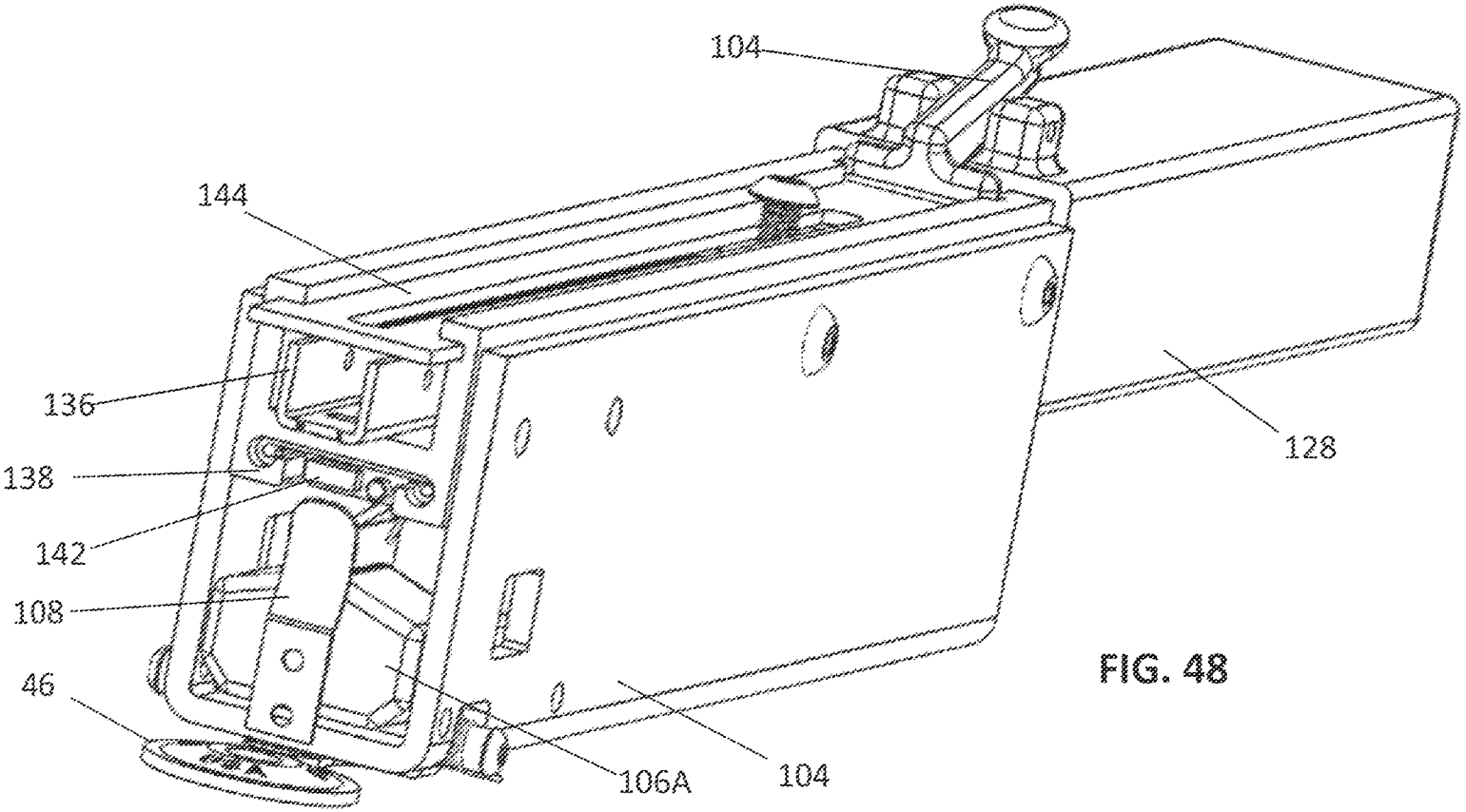
FIG. 48 shows a perspective view of the cap hammer of FIG. 20 with some of the front portion removed showing closed double magazines.

(FIG. 42) back over top of the staples 44 and magazine rail 136 (FIG. 48). This applies spring pressure to both caps 46 and staples 44.

Once the user has loaded the cap and staple magazines 104, 135 with plastic caps 46 and staples 44 and closed the handle 128, the user is ready to use the cap hammer 100.

When the user swings the cap hammer 100 into the work surface, a staple 44 is shot through the top of the cap 46.

The cap 46 is presented under the work contact element 124 (FIG. 33) disposed at the bottom of main head cover 140 and back body cover 110 and held horizontally in place by a cap holding flipper tab 102 (FIG. 22) biased by spring 102A. Work contact element 124 (FIG. 33) is vertically displaceable relative to main head cover 140 and back body cover 110 and is depressed against the work surface during use. Work contact element 124 is attached to main head cover 140 for vertical displacement by cam pivot 112. Two opposing sides of main head cover 140 each include a forward hole 140A and a rearward vertical slot 140B. Two opposing sides of work contact element 124 each include a forward smaller slot 124A and a rearward larger slot 124B. Cam pivot 112 include two cam sides 112C each having a forward rod 112A extending through hole 140A and smaller slot 124A, and a pivot 112B extending through slot 140B and larger slot 124B. For the cap 46 to arrive at this position, it must be sheared off its welded stack. To be sheared, the cap driver blade 114A, which is contained in the internal guide body 130 must be activated. This is achieved the moment the user depresses the work contact element 124 of the cap hammer 100 into the work surface. When the work contact element 124 of the cap hammer 100 depresses, it drives up the cam pivot 112. This cam pivot 112 (FIG. 27) is connected by pivots 112D to the bottom end of the cap driver blade 114A at holes 114C. Once the cap driver blade 114A reaches the top of its stroke, the cap driver blade arms 114B which are notched at the top with notches 114D, catch on the retention rod 116A located at the top of the internal guide body 130.

Figure 25:
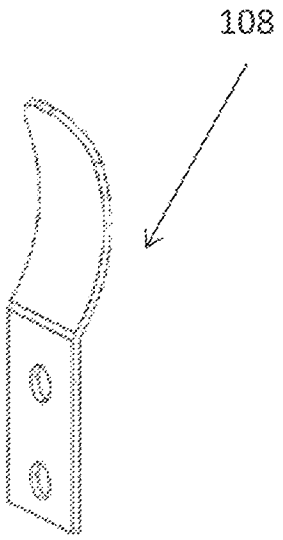
FIG. 25 shows a perspective view of the cap stack retainer spring of the cap hammer of FIG. 20.
Figure 22:
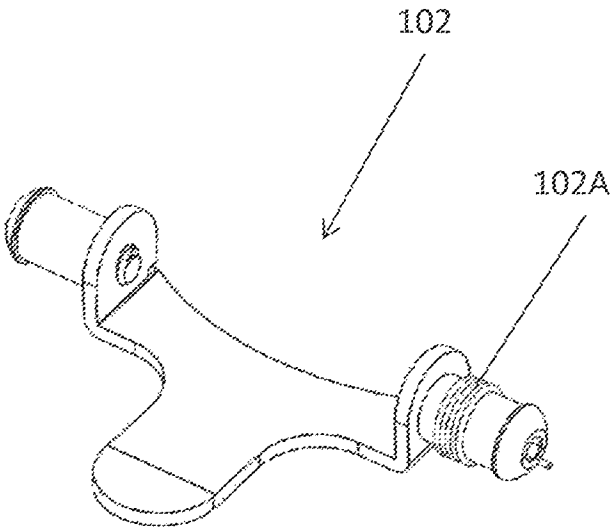
FIG. 22 shows a perspective view of the cap holding tab of the cap hammer of FIG. 20.
Figure 23:
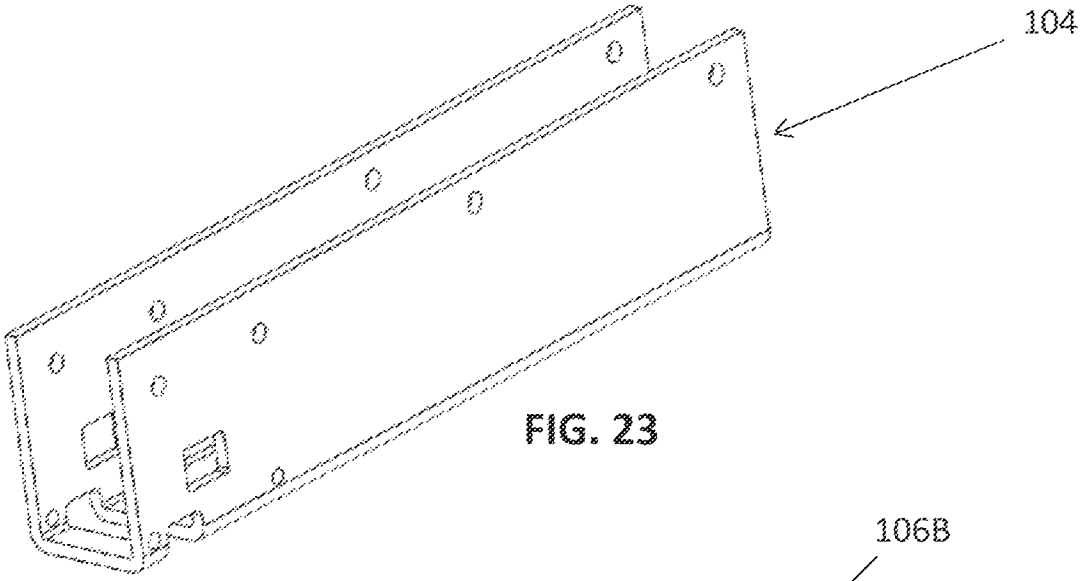
FIG. 23 shows a perspective view of the cap magazine of the cap hammer of FIG. 20.
Figure 24:
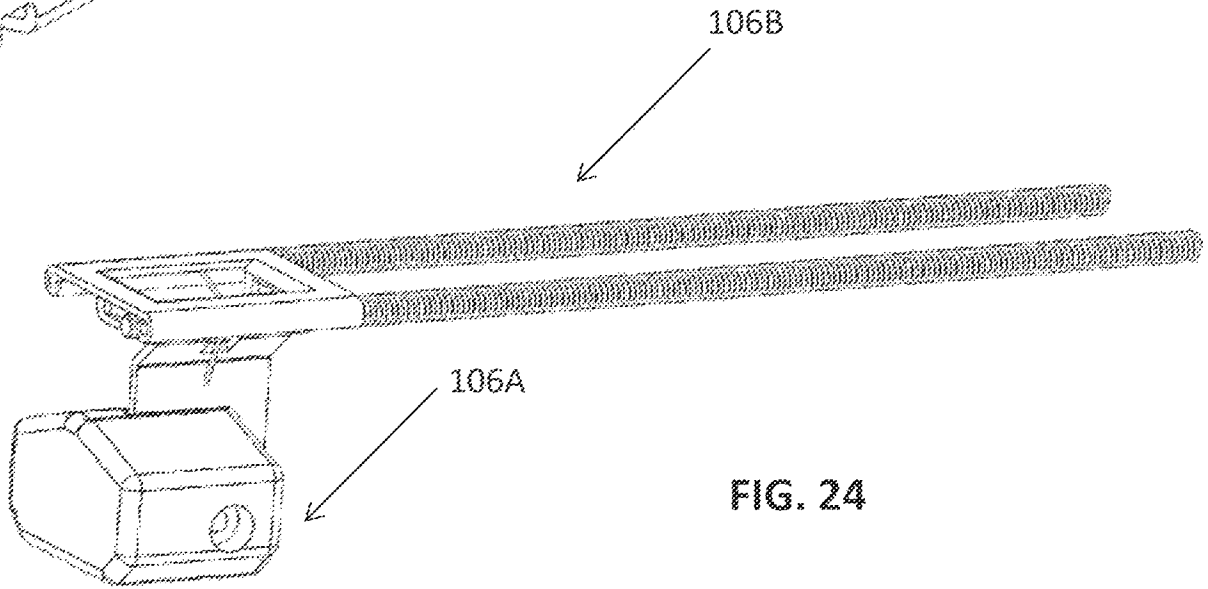
FIG. 24 shows a perspective view of the cap pusher follower and springs of the cap hammer of FIG. 20.
Figure 27:
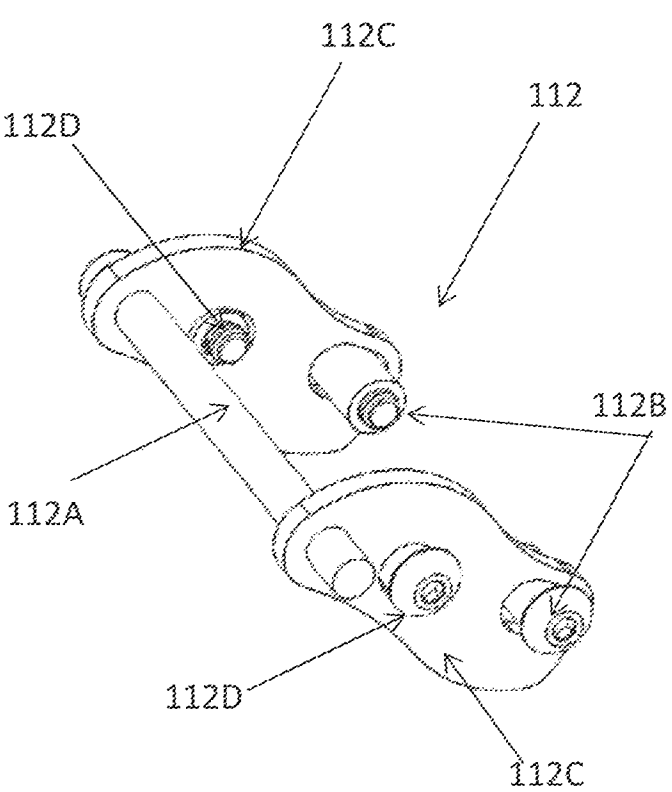
FIG. 27 shows a perspective view of the cam pivot of the cap hammer of FIG. 20.
Figure 26:
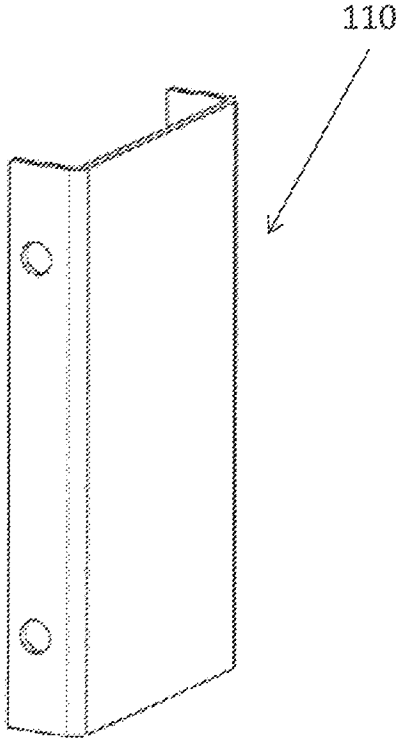
FIG. 26 shows a perspective view of the back body cover of the cap hammer of FIG. 20.
Figure 29:
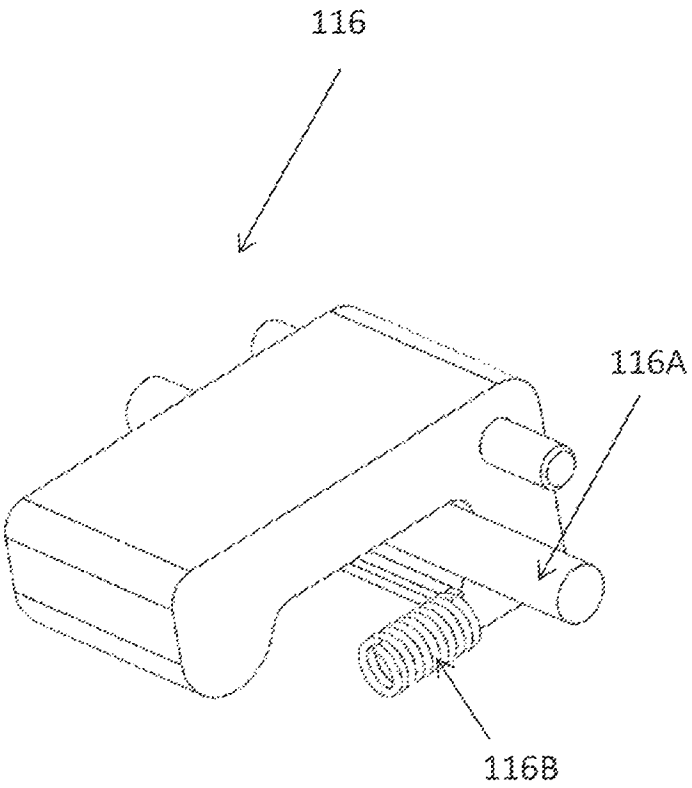
FIG. 29 shows a perspective view of the cap driver blade pivot arm catch of the cap hammer of FIG. 20.
Figure 28:
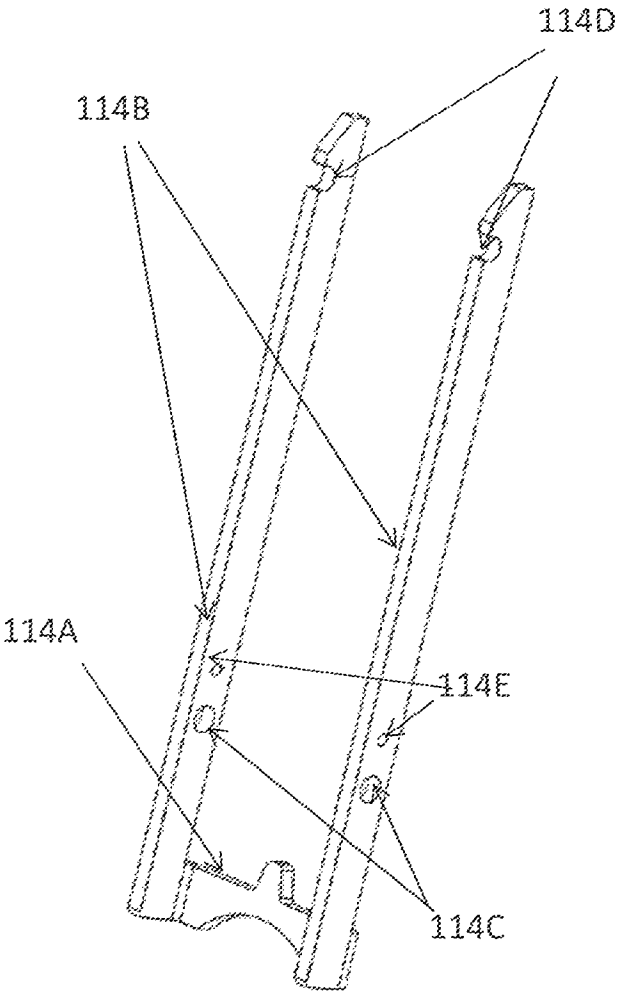
FIG. 28 shows a perspective view of the cap driver blade and arms of the cap hammer of FIG. 20.
Figure 31:
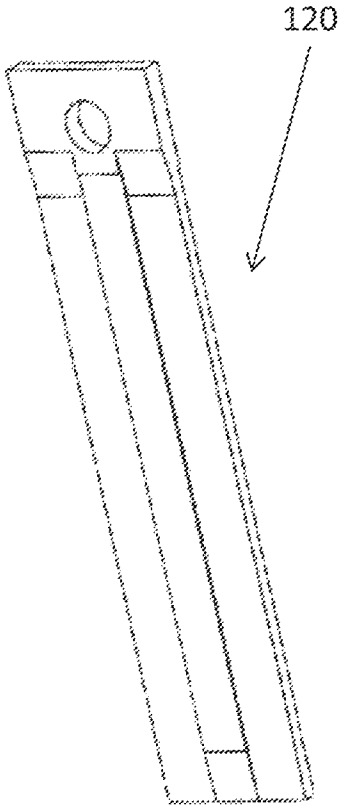
FIG. 31 shows a perspective view of the staple driver blade of the cap hammer of FIG. 20.
Figure 30:
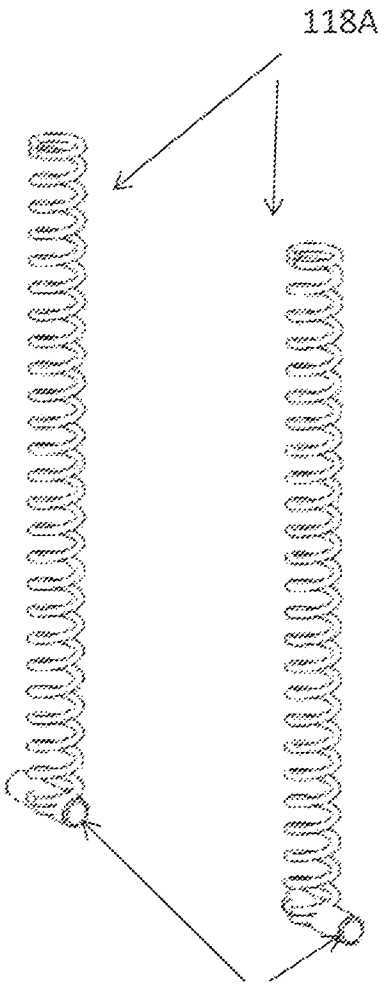
FIG. 30 shows a perspective view of the driver springs and pins of the cap hammer of FIG. 20.
Figure 33:
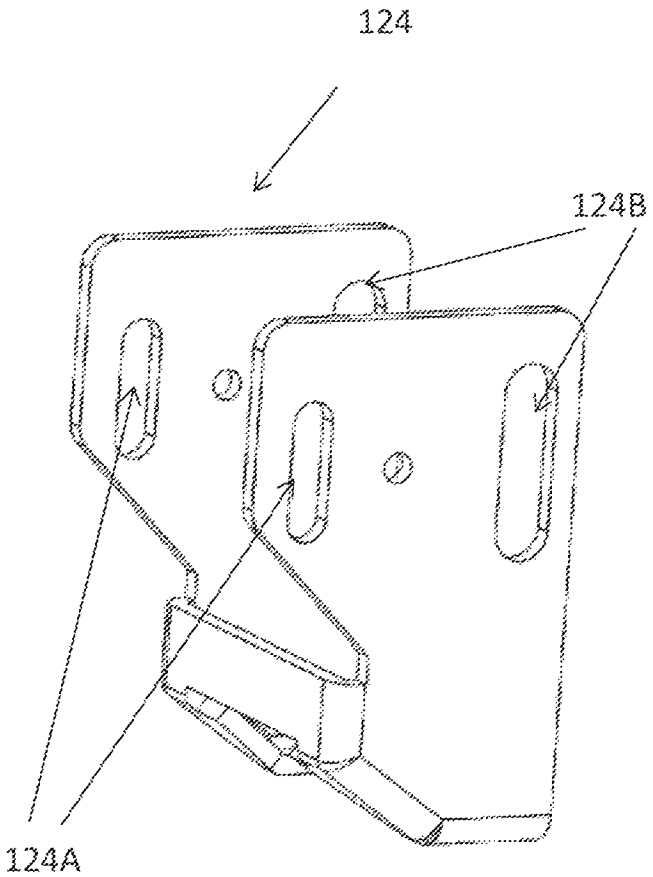
FIG. 33 shows a perspective view of the work contact element of the cap hammer of FIG. 20.

Springs 118A (FIG. 30) are connected to cap driver blade 114A (FIG. 28) by pins 118B through small holes 14E in cap driver blade arms 114B directly above the larger holes 114C. Springs 118A attached to the cap driver blade arms 114B create enough tension so that when the cap driver blade 114A is released, the cap driver blade 114A snaps down with enough force to shear a cap 46 off of the welded stack. For the cap driver blade 114A to be released from its top position, a cap driver blade catch release 116 (FIG. 29) must push the retention rod 116A back into the internal guide body 130 and out of the way. Spring 116B attached to cap blade driver catch release 116 is a small spring to help reset the position of the cap driver blade catch release 116. This cap driver blade catch release 116 is pivoted to release the retention rod 116A by the driver weight 146A coming to the top of its stroke inside of the internal guide body 130. This driver weight 146A (FIG. 43) holds the staple driver blade 120 (FIG. 31) in place and has springs 146B underneath it that return it to the top of its stroke. This driver weight 146A and staple driver blade 120 is what shears a staple 44 and drives it through the cap 46 into the work surface. The striking of the cap hammer 100 onto the work surface causes the driver weight 146A to drive downward by force inside of the internal guide body 130, and the springs 146B underneath return it to the top of its stroke, which then hits the cap driver blade catch release 116 holding the retention rod 116A that is holding the cap driver blade 114A with notches 114D on cap driver blade arms 1148. This design allows for an automatic presentation of caps 46 underneath of the work contact element 124 of the cap hammer 100. FIG. 25 shows cap stack retainer spring 108 which is attached to the inside of the center of the bottom of the cap driver blade 114A, and acts as a stop against the feeding of the cap stack through the middle of the cap driver blade 114A.

Figure 20:
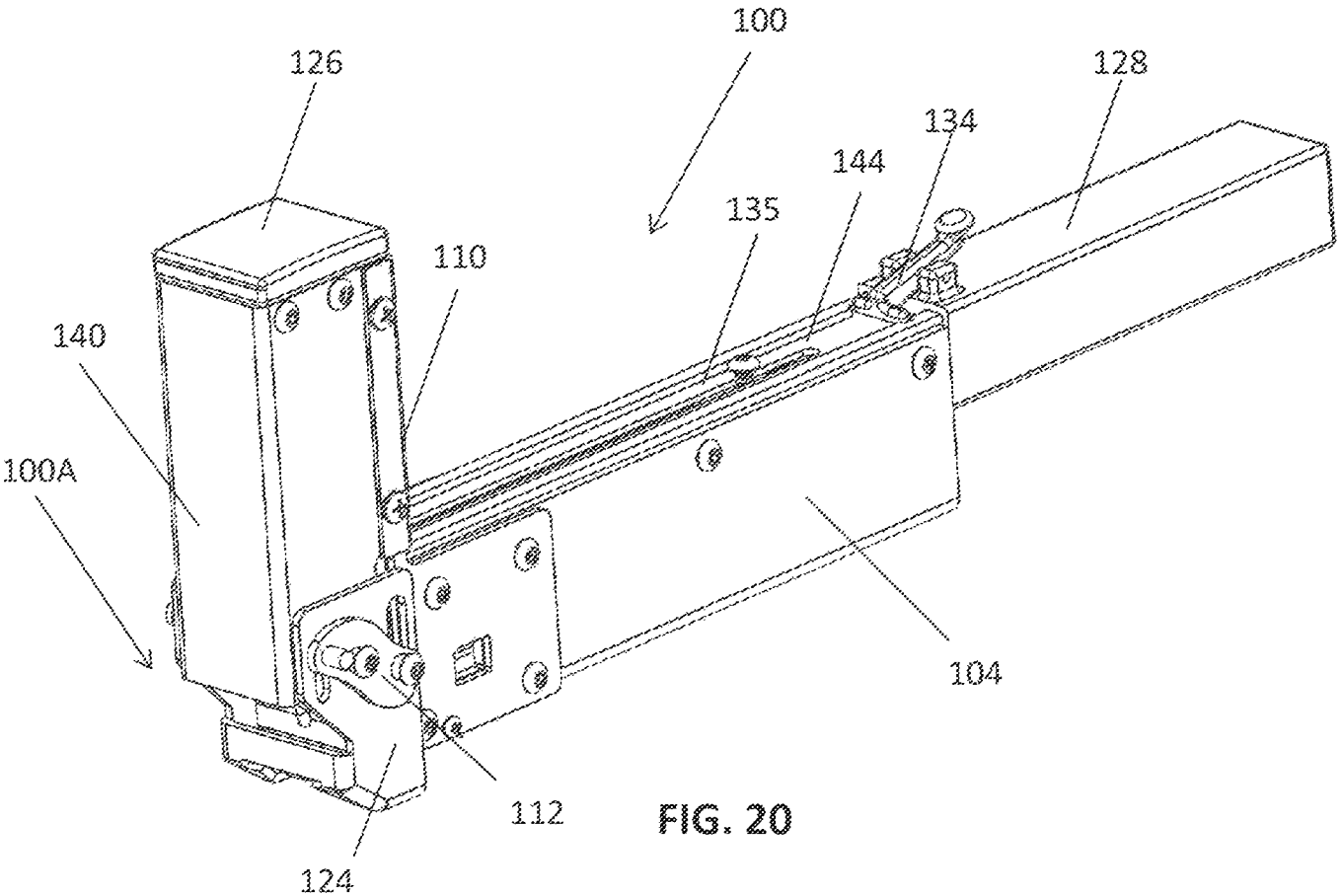
FIG. 20 shows a perspective view of the alternative embodiment of a cap hammer.
Figure 21A:
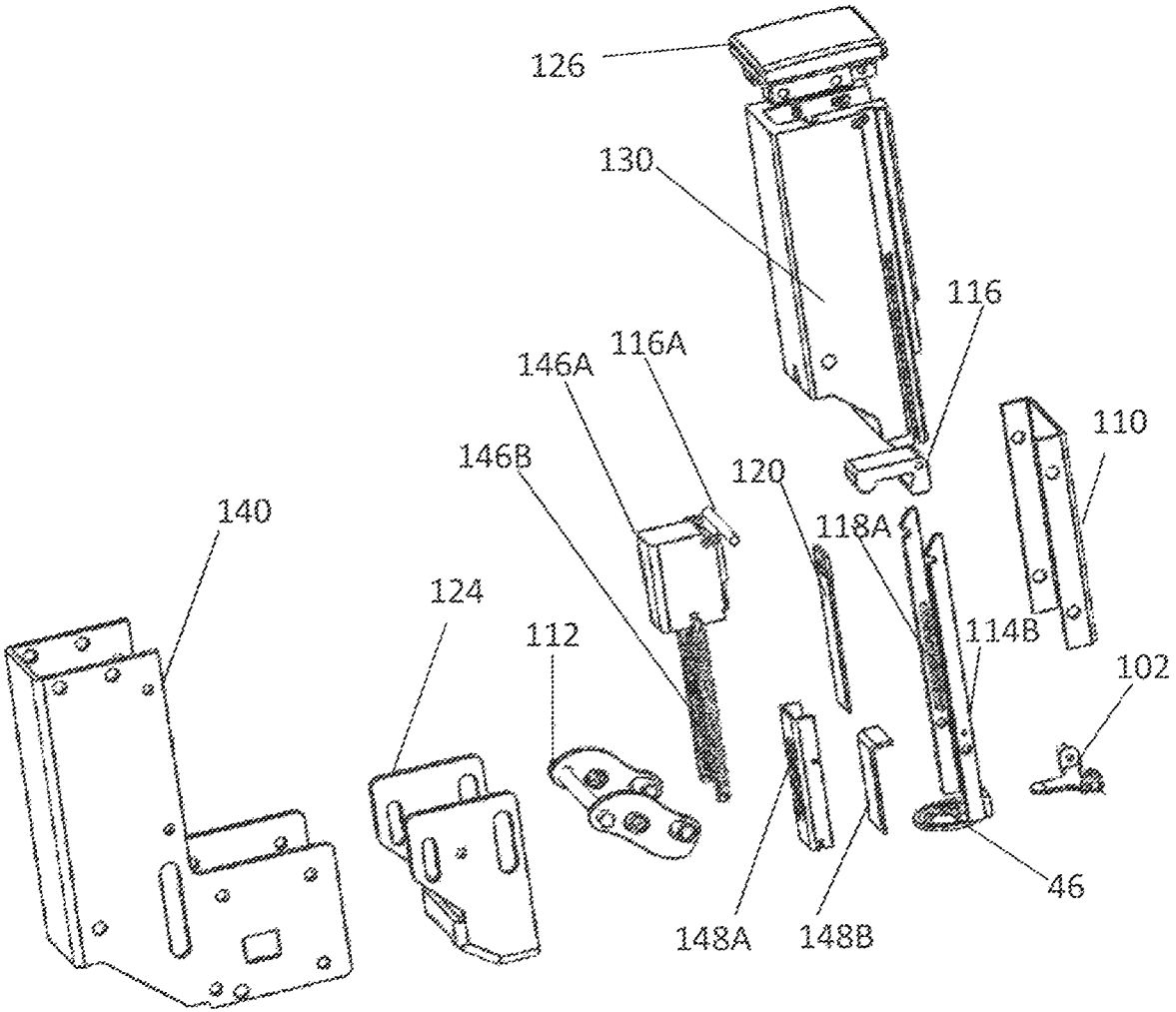
FIGS. 21A and 21B show exploded views of the front and rear portions of cap hammer of FIG. 20.
Figures 21B, 21C:
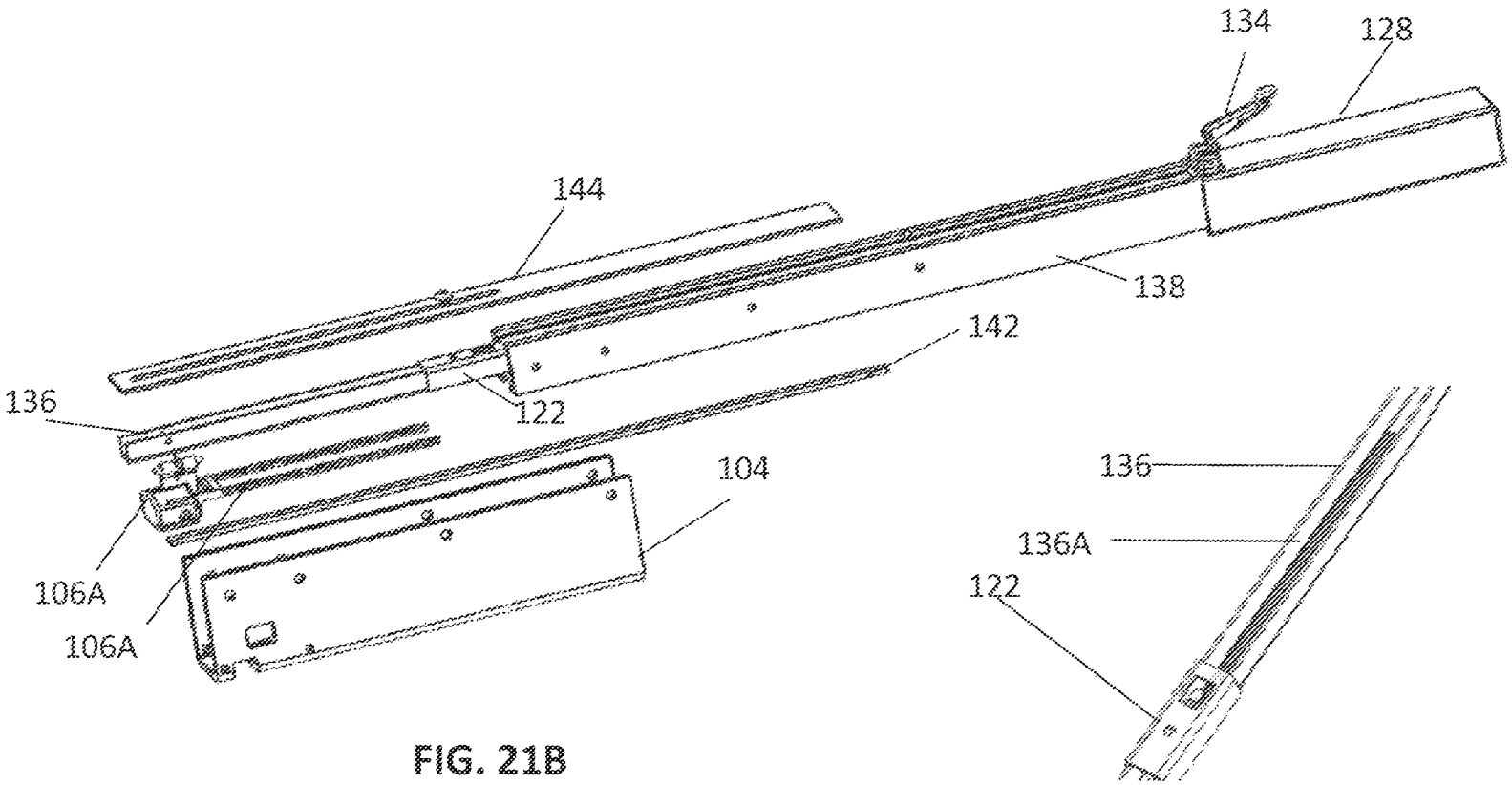
FIG. 21C shows a perspective view of the interior of the magazine rail.
Figures 44A, 44B:
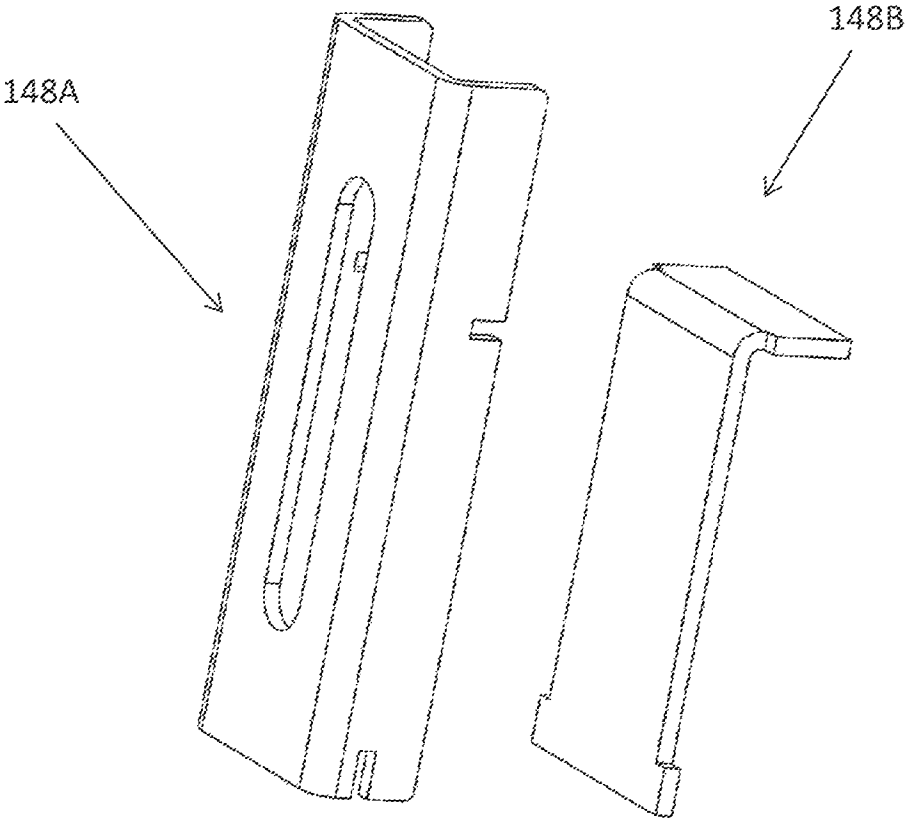
FIG. 44A shows a perspective view of the front staple nose tracks of the cap hammer of FIG. 20.
FIG. 44B shows a perspective view of the back staple nose tracks of the cap hammer of FIG. 20.
Figure 45:
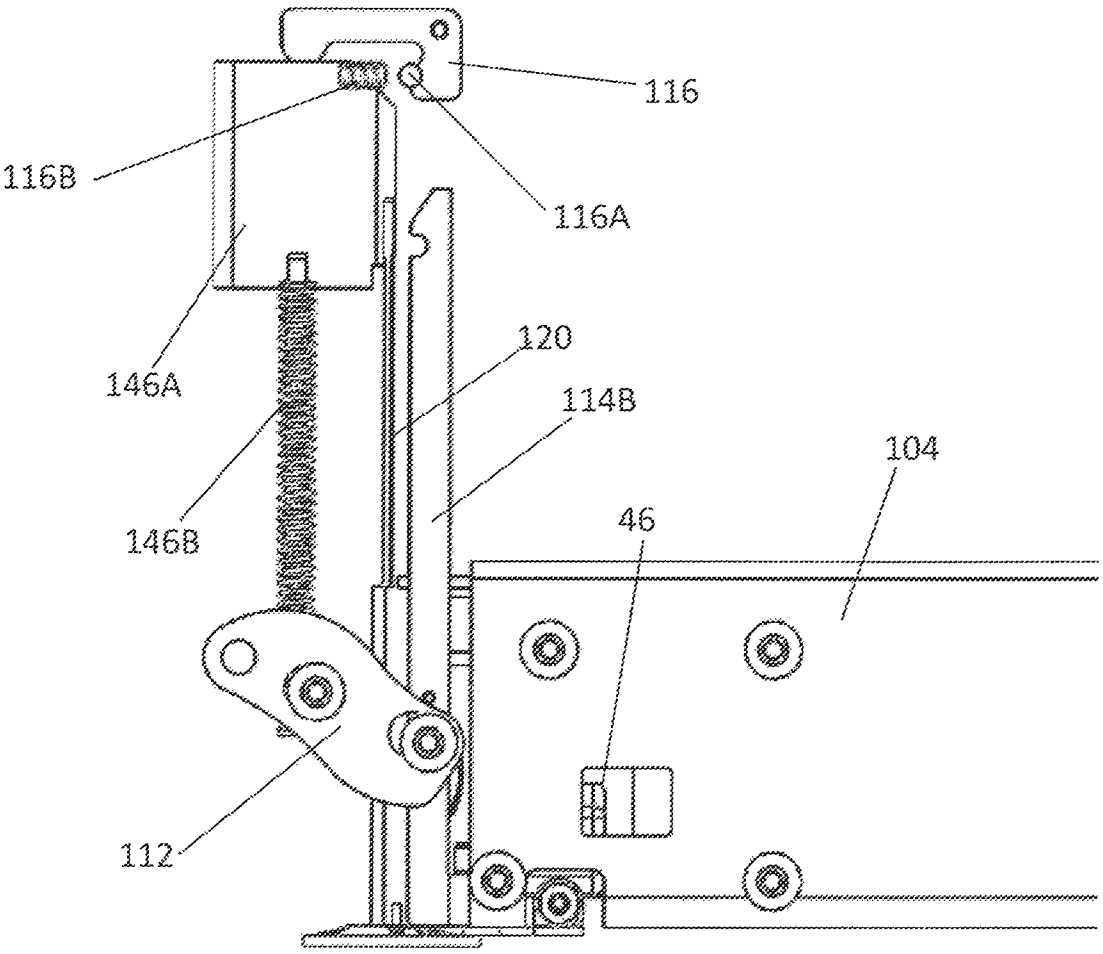
FIG. 45 shows a side view of some of the front portion of the cap hammer of FIG. 20 with some parts removed.
Figure 46:
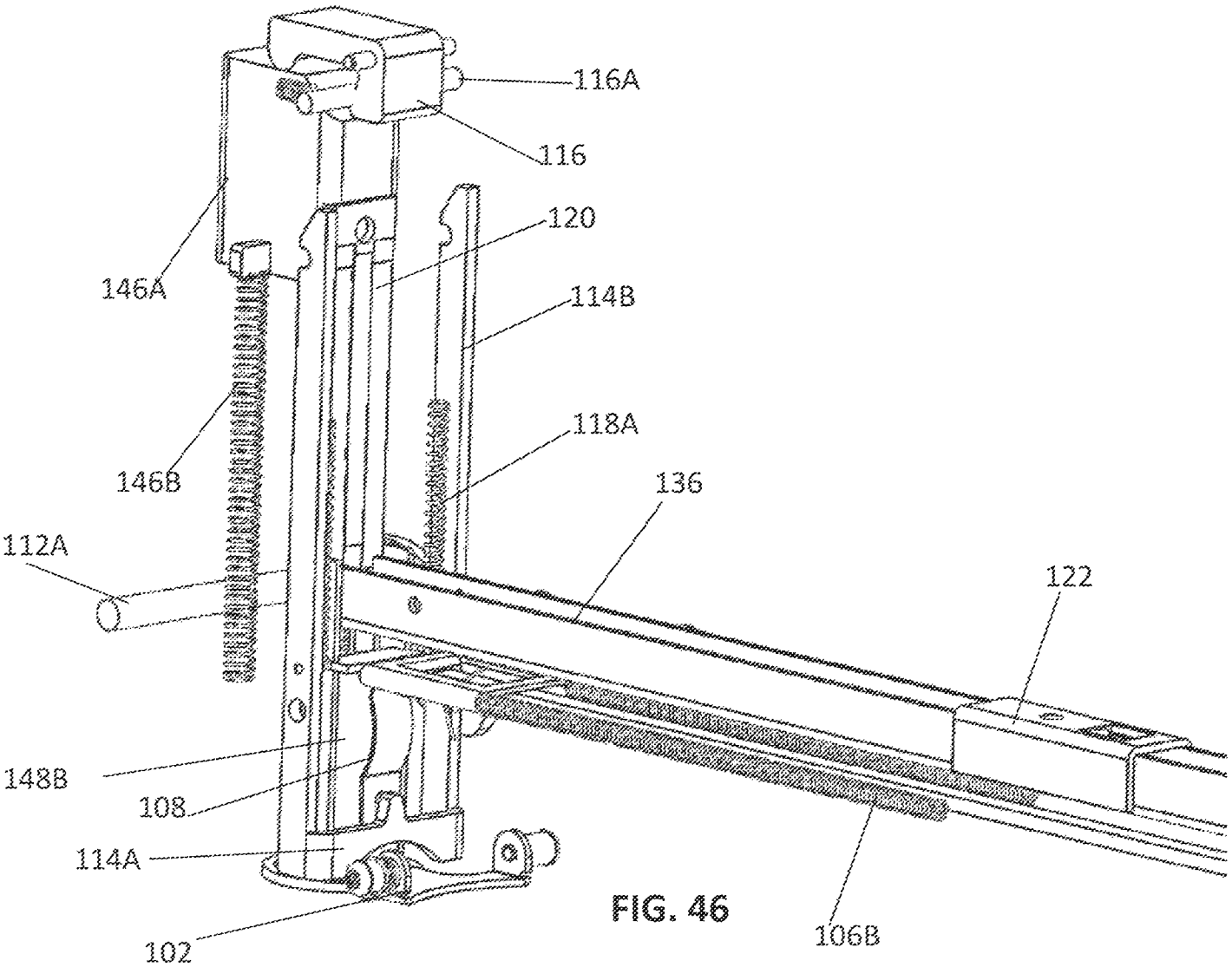
FIG. 46 shows a perspective view of some of the front portion of the cap hammer of FIG. 20 with some parts removed.
Figure 47:
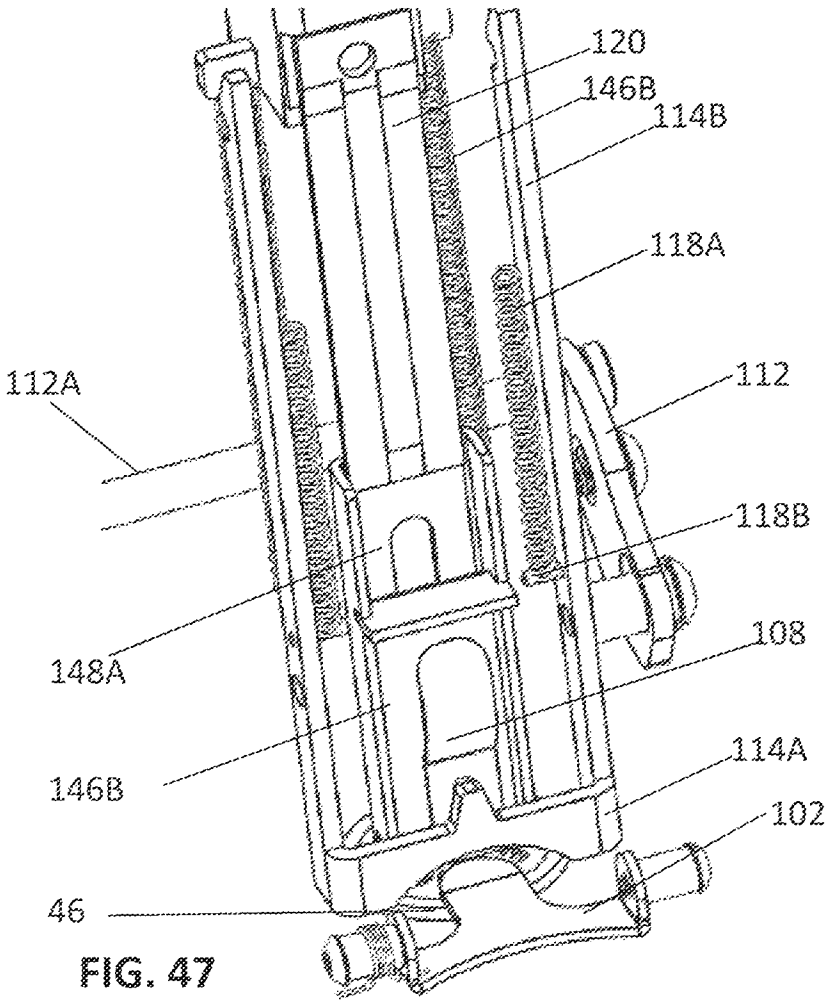
FIG. 47 shows a perspective view of some of the front portion of the cap hammer of FIG. 20 with some parts removed.

FIG. 44A shows a perspective view of the front staple nose tracks 148A of the cap hammer of FIG. 20. FIG. 44B shows a perspective view of the back staple nose tracks 148B of the cap hammer of FIG. 20. The staples enter above the top of the back staple nose tracks 148B, and stop against the back of the inside of the front staple nose track 148A. Directly above the staples is where the staple driver blade 120 rests. When the user slams the cap hammer down, the staple driver blade shears a staple off and drives it down in between both the front staple nose track 148A and the back staple nose track 148B. These two nose tracks act as a guide for the sheared staple and the staple driver blade 120.

A top load staple magazine rail 136 (FIG. 38) design allows for a compact design with a cap magazine 104 (FIG. 23) aligned horizontally under the staples which allows for a two driver blade system that creates a compact automatic cap hammer 100.

The top load staple magazine design on a non-pneumatic staple slap hammer 100 allows for a compact and ergonomic cap hammer 100 design.

The top load staple magazine design allows for the use of a horizontal cap magazine 104 (FIG. 23) holding a horizontal stack of caps underneath of cap hammer 100.

The internal guide body 130 (FIG. 36) design allows for the moving parts to be captured and secured for a more robust cap hammer 100 design.

The internal guide body 130 (FIG. 36) design and cam pivot 112 (FIG. 27) design allow for the use of a hammer head 126 (FIG. 34) on the cap hammer 100.

The user can strike the hammerhead 126 (FIG. 34) of the cap hammer 100 on a surface to drive nails or other things, and not fire a staple 44 or cap 46 because of the cap driver blade 114A and cam pivot 112 designs.

The cap pusher retainer follower 106A (FIG. 24) coming out of the cap magazine 104 and springing to the side by springs 106B allows for quicker loading of caps 46, and further reduces the size and complexity of the cap hammer 100 by eliminating any need for an external puller.

The design of the main body 138 (FIG. 39) allows for simultaneous feeding of staples 44 and caps 46 in a compact single body design and allows for the ability to retract both the rail cover 144 (FIG. 42) and the pusher retainer follower 106A at the same time.

The single action of pulling back the handle 128 (FIG. 35) retracts both the staple magazine cover 144 and the pusher retainer follower 106A (FIG. 24) which allows for much faster reload times and increases the durability of the cap hammer 100 by reducing parts needed for opening and closing each magazine 104, 135.

The single action of swinging the cap hammer 100) onto the work surface accomplishes a multi-cycle action of lifting and locking in place the cap driver blade 114A, accomplishing the shear and driving of staple 44, returning of staple driver weight 146A and staple driver blade 120 and the releasing of cap driver blade 114A which shears the next cap for the next single action, which creates an automatic feeding system of a cap hammer 100.

The double driver blade system allows for robust design and an automatic feeding of the staples and fasteners.

Features of the disclosed embodiments may be combined, rearranged, omitted, etc., within the scope of the invention to produce additional embodiments. Furthermore, certain features may sometimes be used to advantage without a corresponding use of other features.

Many alternatives, modifications, and variations are enabled by the present disclosure. While specific embodiments have been shown and described in detail to illustrate the application of the principles of the invention, it will be understood that the invention may be embodied otherwise without departing from such principles. Accordingly, Applicants intend to embrace all such alternatives, modifications, equivalents, and variations that are within the spirit and scope of the present invention.

What is claimed is:

1. A cap hammer comprising:

a staple magazine configured to hold a plurality of staples;

a cap magazine disposed at an end of the staple magazine and configured to hold a stack of caps;

a guide body disposed at a forward end of the cap hammer;

a cap driver blade disposed within the guide body configured to shear a cap from the stack of caps;

a staple driver blade disposed within the guide body configured to shear a staple from the plurality of staples;

a work contact element disposed at the forward end of the cap hammer and configured to activate the cap driver blade and the staple driver blade when depressed against a work surface during use to drive the sheared staple through the sheared cap into the work surface;

a handle at a rear end of the cap hammer;

wherein the staple magazine comprises:

a main body;

a magazine rail disposed in the main body and configured to support the plurality of staples; and a rail cover configured to removeably cover the magazine rail;

wherein the staple magazine is configured to be loaded with staples from a top of the staple magazine when the rail cover is removed;

wherein the cap hammer further comprises a staple follower disposed on the magazine rail configured to push the staples along the rail; and a pusher retractor rod configured to ride in a groove in a bottom of the main body, and a pusher retainer follower connected to the pusher retractor rod and disposed within the cap magazine beneath the main body configured to push the stack of caps within the cap magazine.

2. The cap hammer of claim 1, wherein the handle is configured to be pulled away from the forward end of the cap hammer to simultaneously retract the rail cover and the pusher retainer follower to allow feeding of additional plurality of staples and stacks of caps.

3. A cap hammer comprising:

a staple magazine configured to hold a plurality of staples;

a cap magazine disposed at an end of the staple magazine and configured to hold a stack of caps;

a guide body disposed at a forward end of the cap hammer;

a cap driver blade disposed within the guide body configured to shear a cap from the stack of caps;

a staple driver blade disposed within the guide body configured to shear a staple from the plurality of staples;

a work contact element disposed at the forward end of the cap hammer and configured to activate the cap driver blade and the staple driver blade when depressed against a work surface during use to drive the sheared staple through the sheared cap into the work surface;

a staple driver weight connected to springs both disposed within the guide body, wherein the staple driver weight is connected to the staple driver blade and configured to drive downward by force inside of the guide body to drive the staple driver blade, and wherein the springs are configured to return the staple driver weight to an original position within the guide body; and a cap driver catch release configured to release a retention rod holding the cap driver blade to allow the release of the cap driver blade when the staple driver weight is returned to the original position.

4. The cap hammer of claim 3, wherein the guide body is disposed with a main head cover, and wherein the work contact element is attached to the main head cover for vertical displacement by a cam pivot.

5. The cap hammer of claim 4, further comprising a hammer head disposed on the main head cover.

* * * * *